US010161369B2

(12) United States Patent
Ikeda et al.

(10) Patent No.: US 10,161,369 B2
(45) Date of Patent: Dec. 25, 2018

(54) INJECTOR BUILT-IN IGNITION DEVICE, INTERNAL COMBUSTION ENGINE, GAS BURNER, AND IGNITION DEVICE

(71) Applicant: IMAGINEERING, INC., Kobe-shi, Hyogo (JP)

(72) Inventors: Yuji Ikeda, Kobe (JP); Seiji Kanbara, Kobe (JP)

(73) Assignee: IMAGINEERING, INC., Kobe-shi (JP)

( * ) Notice: Subject to any disclaimer, the term of this patent is extended or adjusted under 35 U.S.C. 154(b) by 0 days.

(21) Appl. No.: 15/505,402

(22) PCT Filed: Aug. 21, 2015

(86) PCT No.: PCT/JP2015/073620
§ 371 (c)(1),
(2) Date: Mar. 16, 2017

(87) PCT Pub. No.: WO2016/027897
PCT Pub. Date: Feb. 25, 2016

(65) Prior Publication Data

US 2017/0276110 A1 Sep. 28, 2017

(30) Foreign Application Priority Data

Aug. 22, 2014 (JP) ..... 2014-169899
Aug. 24, 2014 (JP) ..... 2014-169977
(Continued)

(51) Int. Cl.
*F02M 57/06* (2006.01)
*F02P 13/00* (2006.01)
(Continued)

(52) U.S. Cl.
CPC ..... *F02M 57/06* (2013.01); *F02P 3/005* (2013.01); *F02P 3/01* (2013.01); *F02P 13/00* (2013.01);
(Continued)

(58) Field of Classification Search
CPC .. F02M 57/06; F02P 3/01; F02P 23/04; H01T 13/44
(Continued)

(56) References Cited

U.S. PATENT DOCUMENTS 8,646,429 B2 * 2/2014 Agneray ..... F02P 9/007 123/145 A
2011/0048381 A1 * 3/2011 McAlister ..... F02M 51/0671 123/472
(Continued)

FOREIGN PATENT DOCUMENTS

JP 7-19142 A 1/1995
JP 7-71343 A 3/1995
(Continued)

OTHER PUBLICATIONS

International Search Report dated Dec. 8, 2015, issued in counterpart International Application No. PCT/JP2015/073620 (1 page).

*Primary Examiner* — John Kwon
*Assistant Examiner* — Johnny H Hoang
(74) *Attorney, Agent, or Firm* — Westerman, Hattori, Daniels & Adrian, LLP

(57) ABSTRACT

The object is to provide an injector with a built-in ignition device that can achieve downsize of device as a whole without changing significantly the structure of a fuel injection device. The injector with the built-in ignition device comprises an ignition device 3 and a fuel injection device 2. In the ignition device 3, an electromagnetic wave oscillated from an electromagnetic wave oscillator MW is boosted by
(Continued)

a booster that is constituted by a resonance structure, a potential difference between a ground electrode 51 and a discharge electrode 31 is increased, and a discharge is caused. In the fuel injection device 2, a valve body part of a nozzle needle 24 is moved toward or away from a valve seat (orifis) 23*a*, and thereby, the fuel injection control is performed. Then, the resonance structure is formed by a dielectric member 30 that is connected to the electromagnetic wave oscillator and formed on the surface of a fuel injection pipe 21, and an inner wall surface 50*a* of a mounting port 50 for an injector of a cylinder head 5. A discharge electrode 31 is a projection that is formed on the surface of the fuel injection pipe 21, and a discharge is caused by making a position of the wall surface of the mounting port 5 that is closest to the discharge electrode 31 as a ground electrode 51.

9 Claims, 25 Drawing Sheets

(30) Foreign Application Priority Data

| | | |
|---|---|---|
| Aug. 29, 2014 | (JP) | 2014-176395 |
| Sep. 12, 2014 | (JP) | 2014-187056 |
| Sep. 19, 2014 | (JP) | 2014-191958 |
| Sep. 29, 2014 | (JP) | 2014-199438 |
| Nov. 21, 2014 | (JP) | 2014-237188 |
| Nov. 26, 2014 | (JP) | 2014-239268 |

(51) Int. Cl.

| | |
|---|---|
| ***F02P 3/00*** | (2006.01) |
| ***F02P 15/08*** | (2006.01) |
| ***F02P 23/04*** | (2006.01) |
| ***F02P 3/01*** | (2006.01) |
| ***F23Q 3/00*** | (2006.01) |
| *F02P 15/00* | (2006.01) |

(52) U.S. Cl.
CPC ..... *F02P 15/08* (2013.01); *F02P 23/045* (2013.01); *F23Q 3/00* (2013.01); *F02P 15/006* (2013.01); *F23D 2207/00* (2013.01)

(58) Field of Classification Search
USPC ..... 123/295–299, 445; 239/533.3
See application file for complete search history.

(56) References Cited

U.S. PATENT DOCUMENTS

| | | | | |
|---|---|---|---|---|
| 2014/0130756 | A1* | 5/2014 | McAlister | F02B 43/00 123/1 A |
| 2015/0322913 | A1* | 11/2015 | Ikeda | F02P 3/01 123/143 B |
| 2017/0241390 | A1* | 8/2017 | Ikeda | F02M 57/06 |
| 2017/0248109 | A1* | 8/2017 | Ikeda | F02M 57/06 |
| 2017/0276109 | A1* | 9/2017 | Ikeda | F02M 57/06 |
| 2017/0298893 | A1* | 10/2017 | Ikeda | H05H 1/52 |

FOREIGN PATENT DOCUMENTS

| | | | |
|---|---|---|---|
| JP | 2005-511966 | A | 4/2005 |
| JP | 2008-255837 | A | 10/2008 |
| JP | 2012-41871 | A | 3/2012 |
| JP | 2012-149608 | A | 8/2012 |
| WO | 2014/115707 | A1 | 7/2014 |

* cited by examiner

FIG. 37
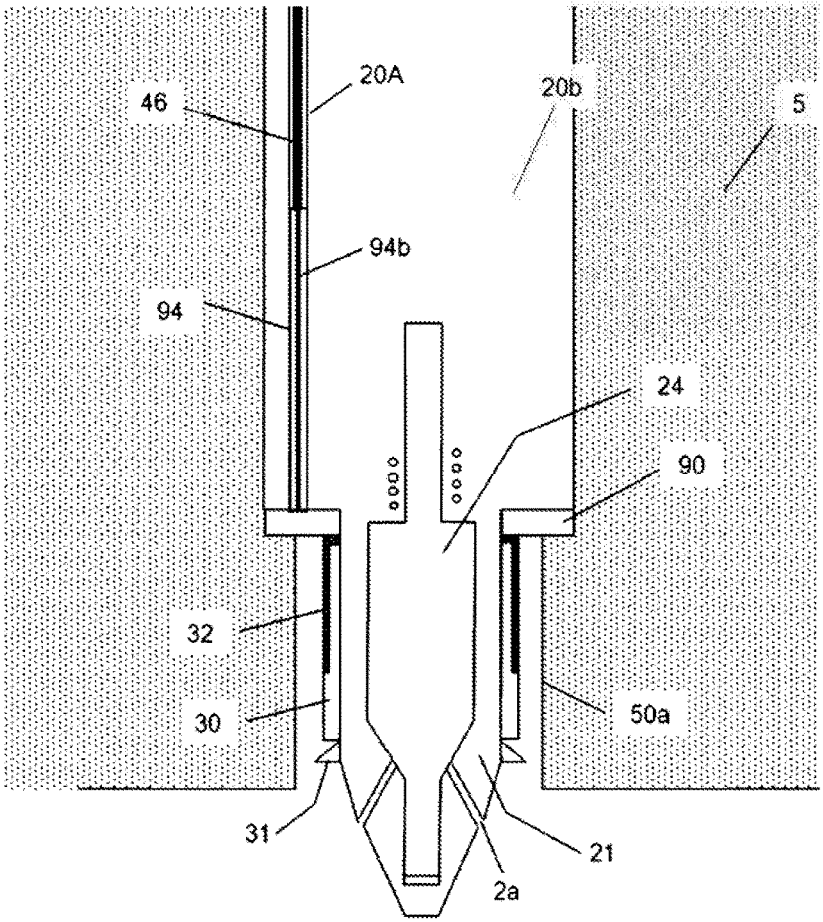
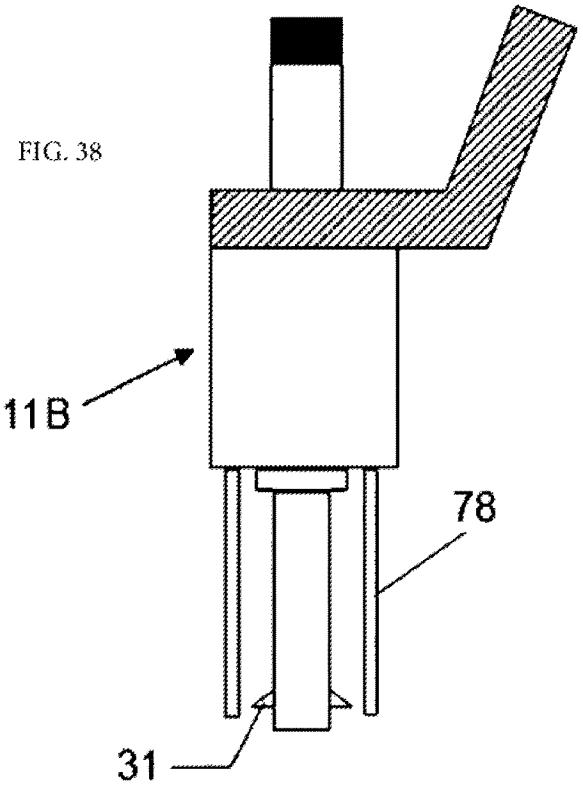
FIG. 38

INJECTOR BUILT-IN IGNITION DEVICE, INTERNAL COMBUSTION ENGINE, GAS BURNER, AND IGNITION DEVICE

TECHNICAL FIELD

The present invention relates to an injector in which an ignition device and a fuel injection device are built-in together, and an internal combustion engine provided with the injector, or relates to a gas burner or the ignition device.

BACKGROUND ART

Various injectors incorporated with the ignition device and the fuel injection device are currently suggested. These are expected to use for the direct injection engine with regard to the diesel engine, the gas engine, or the gasoline engine. The injector incorporated with the ignition device is largely divided into coaxial structural type that the axial center of the injector (fuel injection device) is coincide with the axial center of the center electrode of the spark plug used for the ignition device, and alignment in parallel structural type that the fuel injection device and the ignition device are arranged in parallel and housed inside one casing. The coaxial structural type is disclosed in, for example, in Patent Documents 1 and 2. In the coaxial structural type, the center electrode of the spark plug used as the ignition device is constituted into a hollow type with step which the sheet member is formed at the tip end, and it is constituted such that the needle for opening/closing the sheet member by operation of the actuator is inserted into the center electrode. There is the advantage for easier mounting to the internal combustion chamber.

Moreover, the alignment in parallel structural type is disclosed in, for example, Patent Documents 3 and 4. In the alignment in parallel structural type, the fuel injection device and the spark plug used for the ignition device are aligned inside the cylindrical casing with the predetermined interval, and it is constituted such that the generally-used fuel injection device and the spark plug can be used together. Therefore, there is the advantage that each of the fuel injection device and the ignition plug is not required for being designed newly.

PRIOR ART DOCUMENTS

Patent Document(s)

Patent document 1: Japanese unexamined patent application publication No. H07-71343

Patent document 2: Japanese unexamined patent application publication No. H07-19142

Patent document 3: Japanese unexamined patent application publication No. 2005-511966

Patent document 4: Japanese unexamined patent application publication No. 2008-255837

Non-Patent Document 5: Ambient Air Entraimnent into a Transient Hydrogen Jet and Its Flame Jet (written by Tomita et. al, JSME, The Japan Society of Mechanical Engineers, paper collection. B part, 63-609, paper No. 96-1470, issued on May in year of 1997)

SUMMARY OF INVENTION

Problem to be Solved by Invention

However, there is a problem that, with regard to the injector incorporated with the ignition device disclosed in the Patent Documents 1 and 2, malfunction or damage of the actuator (for example, the electromagnetic coil or piezoelectric element) for operating the needle of the injection nozzle may occur caused by the effect of tens of thousands of volts of high voltage from the ignition coil that flows through the center electrode of the spark plug used as the ignition device. Moreover, regarding injectors incorporated with the ignition device disclosed in the Patent Documents 3 and 4, the fuel injection device and the spark plug used for the ignition device are together arranged inside one casing. For the reason of utilizing the generally-used spark plug, there is a limitation for reduction of the outer diameter length of the spark plug. The outer diameter length of the casing as a whole becomes larger and there has been the problem that it is difficult to secure the mounting space for the internal combustion chamber.

The present invention is made from the above viewpoints, and the purpose is to provide an injector with a built-in ignition device that can achieve a downsize of the device as a whole without changing a structure of a fuel injection device significantly.

A first invention for solving the above problems is an injector with a built-in ignition device, that is arranged in a mounting port of a cylinder head of an internal combustion engine and comprises the built-in ignition device comprising a booster and a discharger, the booster having a resonance structure configured to boost an inputted electromagnetic wave, the discharger being provided at an output side of the booster, and a fuel injection device comprising a fuel injection pipe with a fuel injection port and configured to perform a fuel injection from the fuel injection port of the fuel injection pipe. The resonance structure is configured with a dielectric member formed on a surface of the fuel injection pipe and an inner wall surface of the mounting port of the cylinder head, and the discharger comprises a projection formed on the surface of the fuel injection pipe and configured to cause a discharge between the projection and the wall surface of the mounting port.

Further, a second invention for solving the above problems is an injector with a built-in ignition device, that is arranged in a mounting port of a cylinder head of an internal combustion engine and comprises the built-in ignition device comprising a booster and a discharger, the booster having a resonance structure configured to boost an inputted electromagnetic wave, the discharger being provided at an output side of the booster, and a fuel injection device comprising a fuel injection pipe with a fuel injection port and configured to perform a fuel injection from the fuel injection port of the fuel injection pipe. The resonance structure is configured with a dielectric member that is formed on a surface of the fuel injection pipe and a conductor member that covers a surface of the dielectric member, and the discharger comprises a projection formed on the surface of the fuel injection pipe and configured to cause a discharge between the projection and the wall surface of the mounting port.

Moreover, a third invention for solving the above problems is an injector with a built-in ignition device, that is arranged in a mounting port of a cylinder head of an internal combustion engine and comprises the built-in ignition device comprising a booster and a discharger, the booster having a resonance structure configured to boost an inputted electromagnetic wave, the discharger being provided at an output side of the booster, and a fuel injection device comprising a fuel injection pipe with a fuel injection port and configured to perform a fuel injection from the fuel injection port of the fuel injection pipe. The resonance structure is configured with a dielectric member with a high dielectric constant which is eight or more of relative permittivity, the dielectric member being formed on a surface of the fuel injection pipe, and the discharger comprises a projection formed on the surface of the fuel injection pipe and configured to cause a discharge between the projection and a wall surface of the mounting port.

In above these cases, the dielectric member is constituted by coating a dielectric material on the surface of the fuel injection pipe. Thereby, the structure of the device as a whole can be simplified. Note that, the coating includes a printing of the dielectric material, and a thermal spraying.

Other aspect of the present invention relates to a gas burner. The gas burner comprises a fuel injection device having an injection port and configured to inject fuel from the injection port, a housing member configured to house therein the fuel injection device, an oscillator configured to oscillate an electromagnetic wave, a booster formed on a side surface of the fuel injection device and having a resonance structure configured to boost the electromagnetic wave, an inlet port provided at a side of the injection port and configured to introduce air, and a mixing tube configured to mix the fuel injected from the injection port with the air introduced from the inlet port. The resonance structure is configured with a dielectric member formed on the side surface of the fuel injection device and an inner wall surface of the housing member.

Another aspect of the present invention relates to an ignition device. The ignition device comprises a first conductor configured to propagate an electromagnetic wave through a surface thereof a dielectric member formed on the first conductor, a second conductor that covers the dielectric member, a projection formed on a surface of either one of the first conductor and the second conductor, and a booster having a resonance structure configured to boost the electromagnetic wave. The resonance structure is configured with the first conductor, the second conductor, and the dielectric member, and a discharge is performed between the projection and the second conductor.

Effect of Invention

The injector with the built-in ignition device of the present invention boosts a supplied electromagnetic wave sufficiently by a booster that is constituted by a resonance circuit having a simple structure, increases a potential difference between a discharger and a wall surface of a mounting port of a cylinder head that functions as a ground electrode, causes a discharge, and further ignites surely the fuel injected from a fuel injection device. At that time, the size of the booster that is constituted of a resonance structure can be reduced by increasing a frequency of the electromagnetic wave (for example, 2.45 GHz, or above), and downsize of the device as a whole can be achieved. Moreover, the injector with the built-in ignition device can be provided without performing a significant modification on the fuel ignition device, by forming a transmission path of the electromagnetic wave thereinside, and by forming only a dielectric member and a discharge electrode on the surface of the fuel injection device.

BRIEF DESCRIPTION OF FIGURES

FIG. 4 (*a*1) is a front view of a first example, FIG. 4 (*a*2) is a plane view of the first example, FIG. 4 (*b*1) is a front view of a second example, and FIG. 4 (*b*2) is a plane view of the second example.

FIG. 17 (*a*) is an example that wounds a coil 47 around an upper part 20*a* of a main body part 20, and FIG. 17 (*b*) is an example that wounds the coil 47 around a center part 20*b* of the main body part 20.

FIG. 37 is a front view of a partial cross section that illustrates an injector with a built-in ignition device regarding a modification of the fifteenth embodiment.

FIG. 38 is a front view of a partial cross section of the injector with the built-in ignition device regarding a modification of the twelfth embodiment.

EMBODIMENTS FOR IMPLEMENTING THE INVENTION

In below, embodiments of the present invention are described in details based on figures. Note that, following embodiments are essentially preferable examples, and the scope of the present invention, the application, or the use is not intended to be limited.

(First Embodiment)

Figure 1:
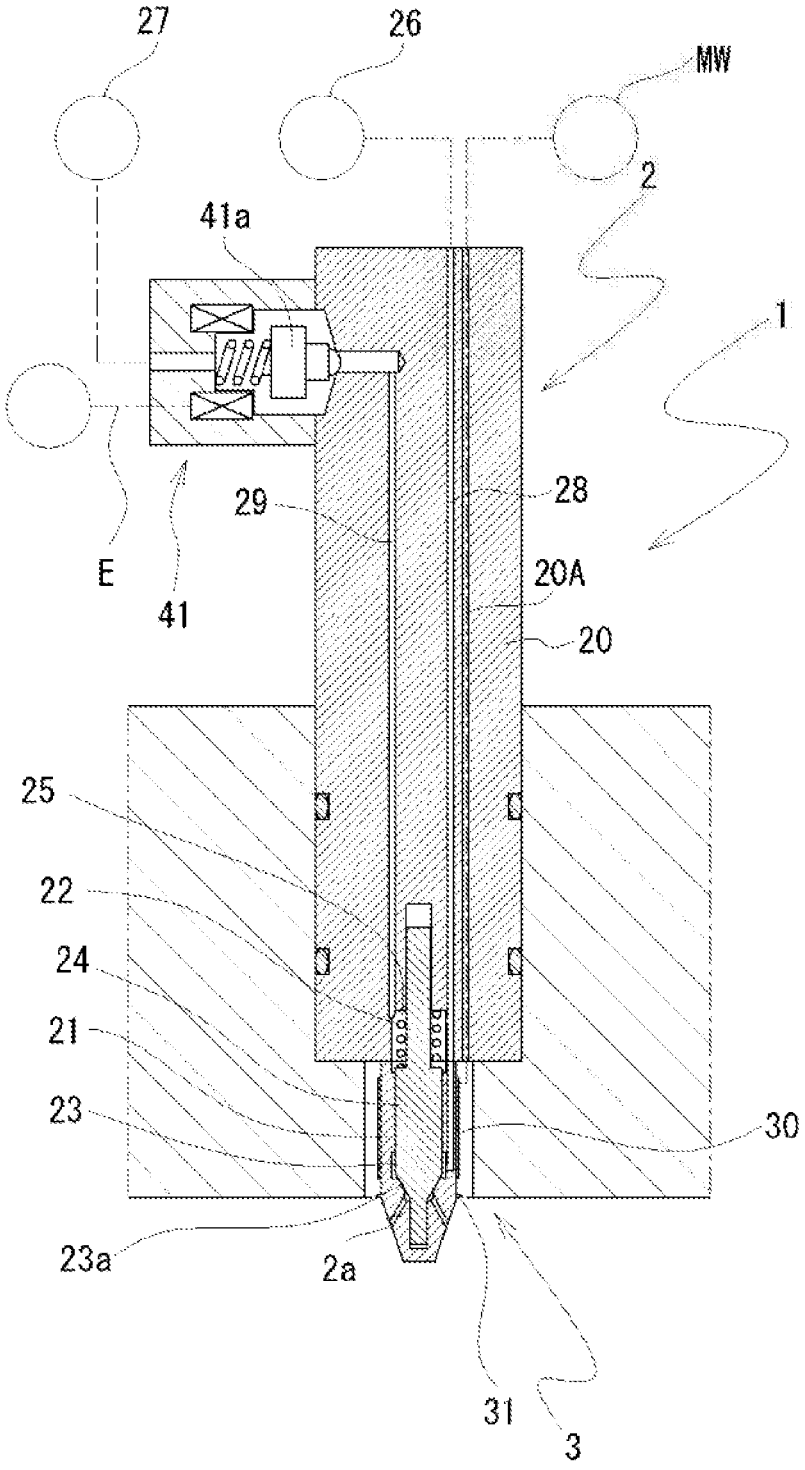
FIG. 1 is a front view of a partial cross section that illustrates an injector with a built-in ignition device of a first embodiment.
Figure 2:
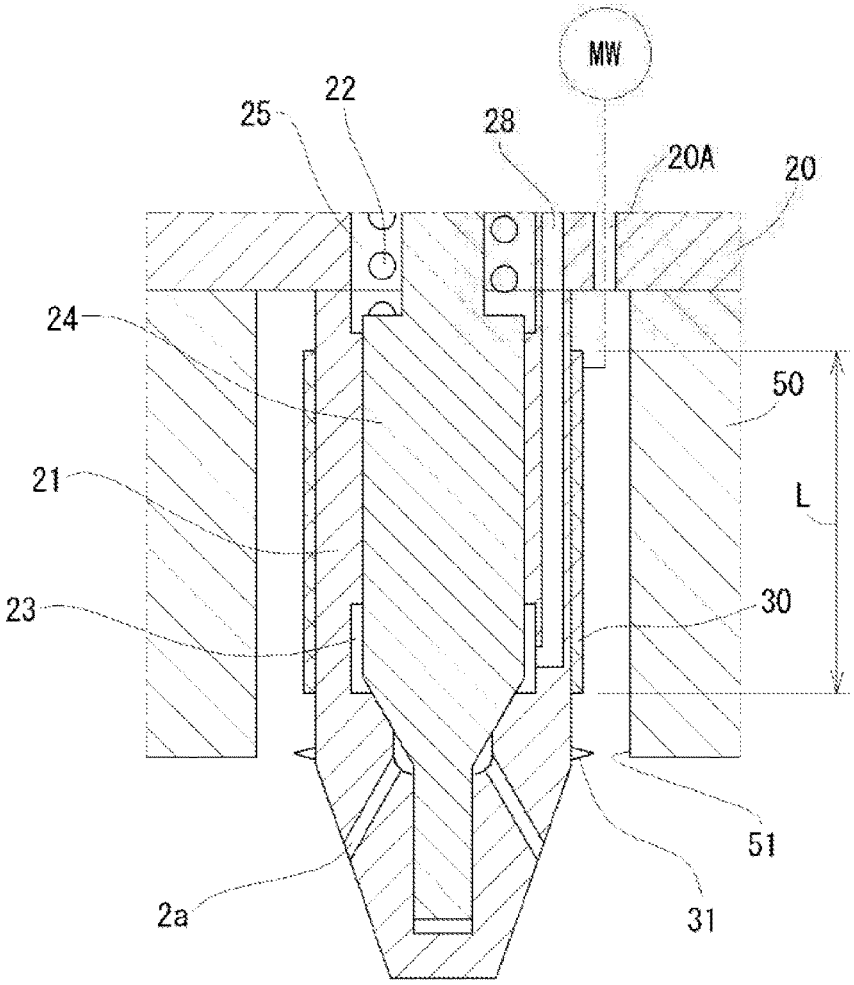
FIG. 2 is an enlarged view of a main part of the injector with the built-in ignition device.

The first present embodiment relates to an injector 1A with a built-in ignition device (in below, it may be referred to solely "injector 1A"). The injector 1A with the built-in ignition device, as illustrated in FIG. 1 and FIG. 2, has a structure that a fuel injection device 2 and an ignition device 3 are together built-in.

The injector 1A includes the ignition device 3 and the fuel injection device 2. The ignition device 3 boosts an electromagnetic wave oscillated from an electromagnetic wave oscillator MW by a boosting means (booster) that is formed by a resonance structure, a potential difference between a ground electrode 51 and a discharge electrode 31 is increased, and a discharge is caused. By moving a valve body part of a nozzle needle 24 toward or away from a valve seat (orifis) 23*a*, the fuel injection of the fuel injection device 2 is controlled. The resonance structure is constituted between a dielectric member 30 connected to the electromagnetic wave oscillator and formed on a surface of the fuel injection pipe 21 and an inner wall surface 50*a* of a mounting port 50 for the injector of a cylinder head 5. A discharge electrode 31 is a projection formed on the surface of the fuel injection pipe 21, and a discharge is caused by making a position of the wall surface of the mounting port 50 closest to the discharge electrode 31 as the ground electrode 51. Generally, the mounting port 50 has a dual structure that includes a large diameter part and a small diameter part. Into the large diameter part, a main body part 20 that mounts an O-ring for shutting off the gas from the combustion chamber on a circumferential surface of the fuel injection device 2 is engaged, and in the small diameter part, the fuel injection pipe 21 is positioned. In the present embodiment, when referred to the wall surface 50*a* of the mounting port 50, unless otherwise specified, it indicates a wall surface of the small diameter part.

—Fuel Injection Device—

The fuel injection device 2 configured to exhibit the fuel injection of the injector 1A includes, as main parts, a fuel injection port 2*a* configured to inject fuel, the orifis (valve seat) 23*a* continuous to the fuel injection port 2*a*, and a nozzle needle 24 provided with a valve body part for opening and closing the orifis 23*a*. The nozzle needle 24 is a hollow cylindrical type, and arranged slidably on an outer surface of a cylindrical member that forms an outer circumference of the ignition device 3 in below described. From a viewpoint of preventing leakage of high pressure fuel inside, it is preferable that a clearance between the inner surface of the nozzle needle 24 and the outer surface of the cylindrical member that constitutes the outer circumference of the ignition device 3 becomes zero as much as possible. The nozzle needle 24 is constituted so as to move toward or away from the orifis 23*a* by operation of an actuator 41. As illustrated, an electromagnetic coil actuator can be used as the actuator 41; however, a piezoelectric element (piezoelectric element actuator) that can control the fuel injection period and the fuel injection timing (multi-stage injection) in nanosecond is preferably used. Note that, the fuel injection device 2 is not limited as above especially, if it is configured to inject the fuel from the fuel injection port 2*a* that is opened at the tip end of the fuel injection pipe 21.

Moreover, a fuel sump room chamber 23 connected to the orifis 23*a* and a pressure room 25 are formed in the main body part 20. Then, the high pressure fuel is introduced from a fuel supply flow path 28 into the fuel sump room chamber 23 and the pressure room 25 by using a fuel pump 26 (including regulator). In a state where fuel is not injected (referring to FIG. 1), a pressure-receiving surface, i.e., load surface of the nozzle needle 24 on which the pressure from the high pressure fuel acts, is larger in the surface of the pressure room 25 than that of the fuel sump room chamber 23, and furthermore, the nozzle needle 24 is biased to the orifis 23*a* side via a biasing means 22 (for example, "spring"). Therefore, fuel does not flow into the fuel injection port 2*a* from the fuel sump room chamber 23 via the orifis 23*a*. The actuator 41 is operated based on injection instructions (for example, driving current E for the fuel injection valve energized to the electromagnetic coil actuator) from a controller (for example, ECU), a valve 41*a* for maintaining air-tightness of the pressure room 25 is pulled up, the high pressure fuel inside the pressure room 25 is released to a fuel tank 27 via an operation flow path 29, and the nozzle needle 24 is moved away from the orifis 23*a* by lowering the pressure inside the pressure room 25. Thereby, the high pressure fuel such as gasoline, diesel oil, gas fuel inside the fuel sump room chamber 23 passes through the orifis 23*a*, and injected from the fuel injection port 2*a*. It is preferably configured that the high pressure fuel released from the pressure room 25 to outside of the injector 1 circulates into the fuel tank 27; however, if gas is used as the high pressure fuel, it can be constituted that the gas is supplied into the intake manifold (intake passage) and then, mixed with the intake air.

A plurality of fuel injection ports 2*a* are preferably formed and opened with a predetermined interval in a circumferential direction. Specifically, multiple fuel injection ports are opened coaxially with the axial center.

—Ignition Device—

The ignition device 3 boosts the electromagnetic wave oscillated from the electromagnetic wave oscillator MW by the boosting means (booster) that is formed by the resonance structure, the potential difference between the ground electrode and the discharge electrode is increased, and the discharge is caused. The resonance structure is constituted by using, for example, a dielectric member 30 formed on the surface of the fuel injection pipe 21 of the fuel injection device 2 (in below, the resonance structure may be referred to "dielectric resonator"). The dielectric member 30 receives supply of the electromagnetic wave from the electromagnetic wave oscillator MW. A capacitor element C formed with the inner wall surface 50*a* of the mounting port 50, and an inductor element L by the dielectric member 30 itself are designed so as to satisfy a relationship of the below mathematical formula 1.

$$f = \frac{1}{2\pi\sqrt{LC}} \quad \text{(formula 1)}$$

In the formula 1, "f" indicates a frequency of the electromagnetic wave. By performing such a design, the resonance structure is constituted. A connection method of the dielectric member 30 and the electromagnetic wave oscillator MW is not especially limited; however, a cable such as a coaxial cable is extended from the electromagnetic wave oscillator MW, and the dielectric member 30 is jointed with the tip end of the cable by using joint means such as welding or brazing. Or, the coaxial cable may be extended via a through-hole that is provided separately on the cylinder head, or the inner wall of the cylinder head may be shaved (cut-off), and the coaxial cable may be put therethrough. Moreover, a through-hole 20A may be provided inside the main body part 20 of the injector 1 (referring to FIG. 1), and the coaxial cable may be put therethrough. Note that, hatching part of the cross sectional view indicates "metal", and cross-hatching part indicates "insulator" (dielectric member). In the present embodiment, microwave as the electromagnetic wave is estimated as having 2.45 GHz band; however, the electromagnetic wave with other frequency band (for example, KHz, MHz, or millimeter wave band) may be used.

In order to resolve an impedance difference between the coaxial cable and the dielectric resonator, an impedance matching circuit may be interposed therebetween. The impedance matching circuit is particularly described in below.

Length 1 of the dielectric member 30 in an axial direction is expressed in below mathematical formula 2, if the wavelength of the supplied electromagnetic wave is λ, and the dielectric constant of the dielectric member is ε, $$l = \frac{\lambda(2n-1)}{4\sqrt{\varepsilon}} \quad \text{(formula 2)}$$

In the formula, "n" is natural number. That is, the length of dielectric member 30 preferably becomes an odd multiple of ¼ wavelength of the electromagnetic wave that flows through the inside of the dielectric member. In this case, if it is designed such that node of the microwave is positioned at the input side of the dielectric member 30, and anti-node of the microwave is positioned at the output side, highest voltage can be obtained. Taking into consideration of constitution of the capacitor between the dielectric member 30 and the inner wall surface 50*a* of the mounting port 50, the distance between the outer surface of the dielectric member 30 and the inner wall surface 50*a* may be adjusted by polishing a corresponding position of the wall surface 50*a*.

Forming method of the dielectric member 30 is not especially limited; however, it can be constituted that the surface of the fuel injection pipe is coated with the dielectric material such as ceramic. Moreover, the dielectric material may be printed or thermally-sprayed on the surface of the fuel injection pipe 21. Further, it may be constituted that a cylindrical member composed of the dielectric material is engaged into. When coating processing, suitable coating can be obtained by polishing the surface of the fuel injection pipe 21. This is specifically effective when the injector of the diesel engine at a secondhand vehicle market (aftermarket) is modified to the injector 1 with the built-in ignition device. When coating processing, by intentionally performing uneven coating, suitable resonance structure can be obtained.

The fuel injection pipe 21 which is a tip part of the injector 1 with the built-in ignition device, is originally separated from the inner wall surface 50*a* of the mounting port 50. Therefore, even if the coating and etc. is performed on the surface of the fuel injection pipe 21, an inconvenience that the injector 1 cannot be inserted into the mounting port 50 does not occur. Note that, in such a case where the thickness of the dielectric member 30 is increased and the dielectric member 30 cannot be put inside the cavity, the surface of the fuel injection pipe 21 may be cut off, a recess portion may be formed, and the dielectric member 30 may be formed inside the recess portion.

The discharge electrode 31 is formed by a projection provided at the combustion chamber side further than the dielectric member 30 on the surface of the fuel injection pipe 21. The projection can be formed by arranging a metal ring such as a "Fire Ring" which is pointed-sharpened at the tip end on the surface of the fuel injection pipe 21. The metal ring may be formed integrally together with the fuel injection pipe 21. Moreover, a plurality of projections with cone shape may be formed on the same circumference. A height of projections is not required to be aligned. By intentionally providing non-uniformed heights and setting unfixed distance between the discharge electrode 31 and the ground electrode 51, in a case where the frequency of the supplied electromagnetic wave (microwave) may fluctuate, discharge can be caused at any one of position that has a most suitable distance.

Figure 4:
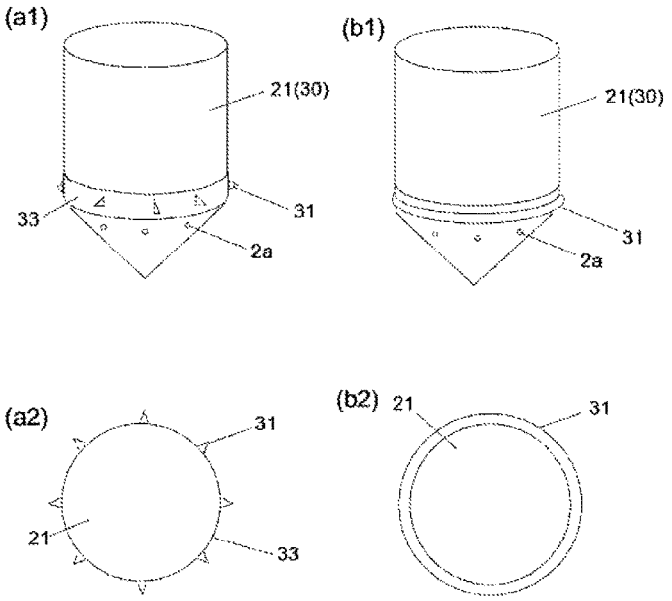
FIG. 4 is a view that illustrates a structural example of a discharge electrode of the injector with the built-in ignition device of the first embodiment.

FIG. 4(*a*) is an example that multiple cone-shape projections (discharge electrodes) 31 are formed on a similar circumference of a metal ring 33. FIG. 4(*b*) is an example that the projections (discharge electrodes) 31 are provided on the metal ring 33 with ring state.

When designing is performed such that the length of the dielectric member 30 becomes ¼ wavelength of the microwave for optimization of the resonance structure by the dielectric member 30, and anti-node of the microwave is located at the bottom end of the dielectric member 30, the potential of the microwave becomes highest at the bottom end of the dielectric member 30. Therefore, the position of the discharge electrode 31 is preferably close to the bottom end of the dielectric member 30 as much as possible. That is because the potential is lowered if the distance between the discharge electrode 31 and the dielectric member 30 is widely spaced. Accordingly, the metal ring 33 is preferably positioned directly under, i.e., immediately below the dielectric member 30.

There is a case where the distance between the ground electrode 51, inner wall surface 50*a*, and the discharge electrode 31 is varied due to the dimensional engineering tolerance on manufacturing; however, by intentionally being projection heights unfixed, it can be coped with such dimensional engineering tolerance. Moreover, when a cleaning of the cylinder head is performed, the inner wall surface 50*a* is eventually cut off by cleaning or polishing, and it is difficult to predict accurately how deep the inner wall surface is cut off. On the other hand, if the length of cone-shape projections are unfixed, an effect that discharge is possibly caused between any one of projections and the inner wall surface 50*a* can be obtained, even if there is a variation in cutting degree (amount).

Of course, the heights of the projections may be aligned. In this case, the discharge (ring state discharge) can be generated around whole circumference of the fuel injection pipe 21, and ignition can be performed in all directions.

The metal ring 33 may be arranged on the surface of the dielectric member 30.

If the metal ring 33 that is sharpened at the tip ends is arranged on the surface of the fuel injection pipe 21, the discharge electrode can be constituted only by inserting the metal ring into an injector in existence. Therefore, it is effective when the injector 1 with the built-in ignition device is used as goods for "aftermarket".

The discharge electrode 31 is provided on a corresponding position of the ground electrode 51 that is arranged on the wall surface 50*a* of the mounting port 50. On the corresponding position, a plurality of metal rings that are sharpened at the tip ends or cone-shape projections can be formed on a similar circumference. Thereby, a discharger can be formed without arranging projection(s) directly on the surface of the fuel injection pipe 21.

—Operation of Ignition Device—

A discharge of an ignition device 3 (plasma generation) is explained. On the discharge, an electric potential difference of spaced discharge gap (discharger) between the discharge electrode 31 and the ground electrode 51 is increased, and thereby, plasma is generated in the vicinity of the discharger, and the fuel injected from the fuel injection valve is ignited.

Plasma generation is specifically explained. First, a controller (not illustrated) outputs an electromagnetic wave oscillation signal with a predetermined frequency f. The oscillation signal is outputted simultaneously with the fuel injection signal transmitted to the fuel injection device 2, i.e., a timing that a predetermined period of time passes after transmission of the fuel injection signal. The electromagnetic wave oscillator MW that receives a power supply from the electromagnetic wave source (not illustrated), when it receives such an electromagnetic wave oscillation signal, outputs an electromagnetic wave pulse with the frequency f on a predetermined duty ratio over a predetermined set period. The electromagnetic wave outputted from the electromagnetic wave oscillator MW is supplied into the dielectric member 30 that has the length 1 as above-mentioned, and boosted by, for example, resonation with the wall surface 50*a* of the mounting port 50. As an example, an inner diameter of the small diameter part of the mounting port 50 is around 8 mm, an outer diameter of the fuel injection pipe 21 is around 7 mm, and the clearance therebetween is around 0.5 nm.

Then, the electromagnetic wave that is boosted and becomes high voltage increases the potential difference at the discharger. At the discharger the discharge electrode 31 is projected from the surface of the fuel injection pipe 21, and thereby, the gap, i.e., clearance between the discharge electrode 31 and the ground electrode 51 is narrow. That is, since the gap (clearance) is narrower than the clearance between the inner wall surface 50*a* of small diameter part of the mounting port 50 and the outer surface of the fuel injection pipe 21, discharge does not occur at other parts except for the discharger, and the discharge is caused only at the gap between the discharge electrode 31 and the ground electrode 51. By the discharge, electrons are released from the gas molecules generated in the vicinity of the discharger of the ignition device 3, the plasma is generated, and the fuel is ignited. Note that, the electromagnetic wave from the electromagnetic wave oscillator MW may be a continuous wave (CW).

—Effect of First Embodiment—

The injector 1A with the built-in ignition device of the present first embodiment uses the ignition device 3 in a small diameter that can boost an electromagnetic wave and perform a discharge, and therefore, malfunction or damage of the actuator 41 caused by the effect of the high voltage from the ignition coil can be prevented. Since only a transmission path for supplying the electromagnetic wave is provided inside the main body of the fuel injection device 2, significant reduction of the outer diameter length of the device as a whole can be achieved. Moreover, heat from the fuel injection device 2 and the ignition device 3 is cooled down by the fuel that flows through the fuel supply flow path 28 and the operation flow path 29.

Moreover, since the structure that discharge is caused in the vicinity of the fuel injection port 2*a* is adopted, an effect that a deposit such as carbon that is deposited on the fuel injection pipe 21, particularly, the fuel injection port 2*a*, is completely burned out, can be obtained.

The plasma is generated caused by discharge in a semi-closed space (cavity) that is surrounded by the inner wall 50*a* of the mounting port 50 of the cylinder head 5, the main body part 20 of the injector 1, the fuel injection pipe 21, and the discharge electrode 31, and therefore, in the injector 1 of the present embodiment, similar structure as sub-chamber engine can be achieved. Accordingly lean-burn combustion can be achieved, and fuel consumption reduction, NOx reduction and etc. can also be achieved.

A heat insulator may be arranged on the inner wall 50*a* of the mounting port 50 of the cylinder head 5 in order to achieve the additionally-obtained-sub-chamber effect more efficiently, and so as to prevent heat in cavity from escaping toward the cylinder head 5.

The fuel injection/discharge timing by the injector 1A may be, for example, a timing when the fuel injection starts at around −120 degrees of the crank angle (before 120 degrees of TDC), and the discharge is performed on the phase of the crank angle around −30 degrees. In the injector 1A, the fuel injection port 2*a* is positioned below the discharge electrode 31; however, the fuel injected from the fuel injection port 2*a* is flown upward as the piston ascends. The discharge is performed (the microwave is applied to the discharge electrode 31) on a timing when the fuel reaches to the vicinity of the discharge electrode 31. By doing so, ignition can be performed efficiently. Moreover, the cavity inside becomes high pressure in accordance with ascending of the piston and ignition, and therefore, the ignited flame diffuses downward (combustion chamber) by one kind effect of plasma jet. Accordingly, if the fuel injection and the discharge are performed in this order, the discharge is performed in a state where the fuel amount is abundant and therefore, the ignition is easy to occur.

However, on the other hand, there is a problem that the discharge voltage should make higher sufficiently since the discharge is required to occur at a timing closely to TDC (under the high pressure). Accordingly, firstly the discharge is performed, and then, the cavity inside is made high pressure by the heat generated through discharge, and the plasma is effectively introduced downward (in the vicinity of the fuel injection port 2*a*), and then, the fuel may be injected from the fuel injection port 2*a*.

Note that the above-mentioned effect is achieved in the fuel other than CNG, such as gasoline.

Figure 33:
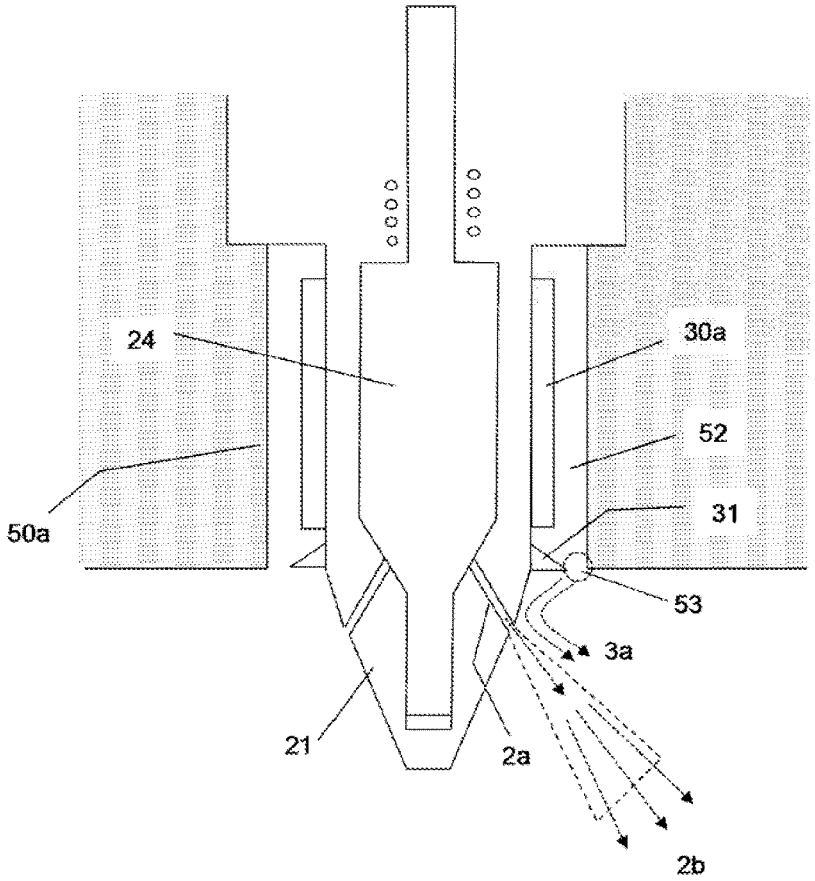
FIG. 33 is a view that explains an "entrainment" effect of plasma by a fuel jet stream.

Moreover, in a cylindrical direct injection internal combustion engine such as a diesel engine, fuel that is injected into a high pressure air region in high temperature, is known to trap surrounding-air into, i.e., air entrainment, and move (for example, non-patent document 1). Accordingly, as illustrated in FIG. 33, plasma 3*a* generated in a gap 53 between the discharge electrode 31 and the ground electrode 51, is trapped into the fuel 2*b* injected from the fuel injection port 2*a* by the "air entrainment" effect. By this, plasma contributes to the fuel ignition. In this case, plasma is introduced from backward side of fuel, and therefore, the backward of fuel (tail) is first and earlier ignited.

—Modification of First Embodiment—

In the first modification of first embodiment, the structure other than difference of joint method of the dielectric member 30 and the electromagnetic wave oscillator MW is similar with the first embodiment, and therefore, the explanation is omitted.

Figure 3:
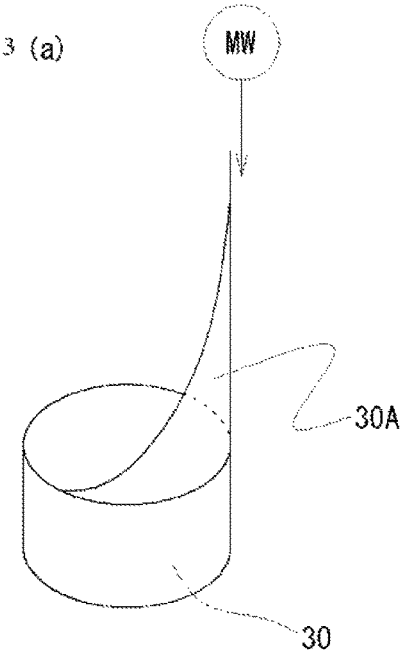
FIGS. 3 (*a*) and (*b*) are a schematic view that illustrates another jointing method of a dielectric member and an electromagnetic wave oscillator.
Figure 3:
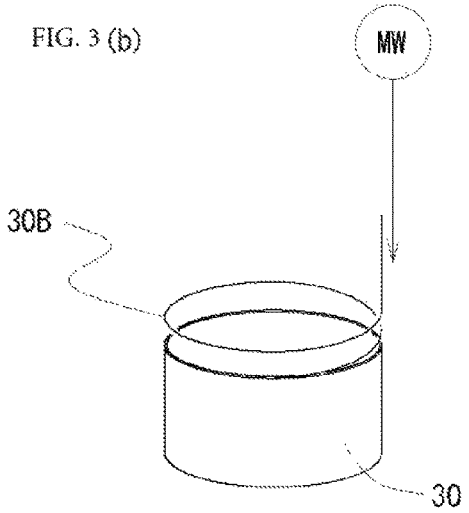

With regard to a dielectric member 30 and a cable (for example, coaxial cable) extended from the electromagnetic wave oscillator MW of the present modification, as illustrated in FIG. 3(*a*), the end surface of the cylindrical dielectric member 30 is connected to the cable tip part extended from the electromagnetic wave oscillator MW via a taper coupling part 30A. By such a connection, reflected wave at a joint point is reduced, and connected smoothly i.e., the electromagnetic wave band region is widen and the ease of handling is improved.

—Second Modification of First Embodiment—

In the second modification, the structure other than different joint method of the dielectric member 30 and the electromagnetic wave oscillator MW is similar with the first embodiment, and therefore, the explanation is omitted.

With regard to the dielectric member 30 and the cable extended from the electromagnetic wave oscillator MW of the modification, for example, the coaxial cable, as illustrated in FIG. 3(*b*), a wounding part 30B is constituted such that the tip end of the cable is wounded around the surface of the fuel injection pipe 21 and extended toward the end surface of the cylindrical dielectric member 30, and a predetermined length portion of the tip end is jointed with the end surface of the dielectric member 30. The extended length on wounding performance is preferably set to be an integer multiple of $\lambda/4$. By such joint, as well as the first modification, the reflected wave is reduced at the joint point, and connected smoothly. i.e., the band region of the electromagnetic wave is widen and the ease of handling is improved.

—Second Embodiment—

Figure 5:
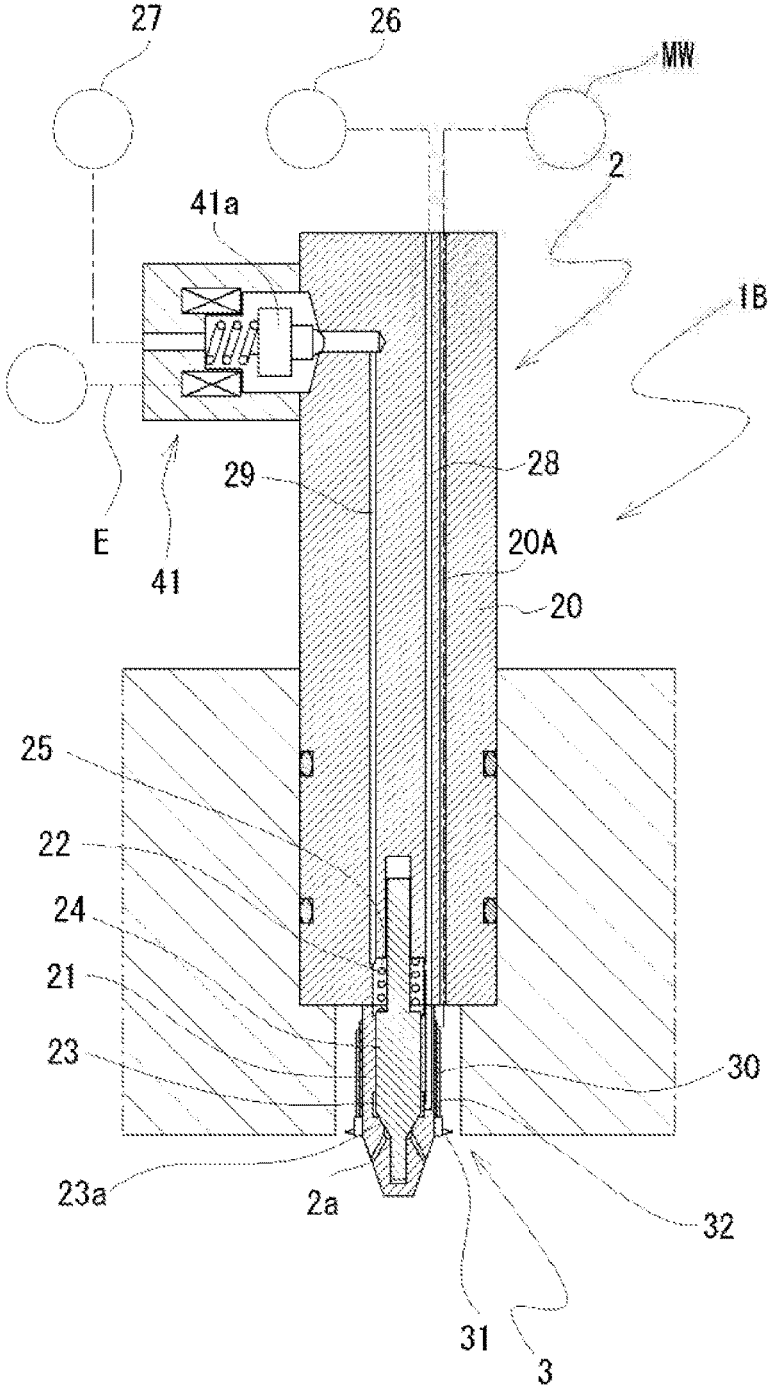
FIG. 5 is a front view of a partial cross section that illustrates an injector with a built-in ignition device of a second embodiment.
Figure 6:
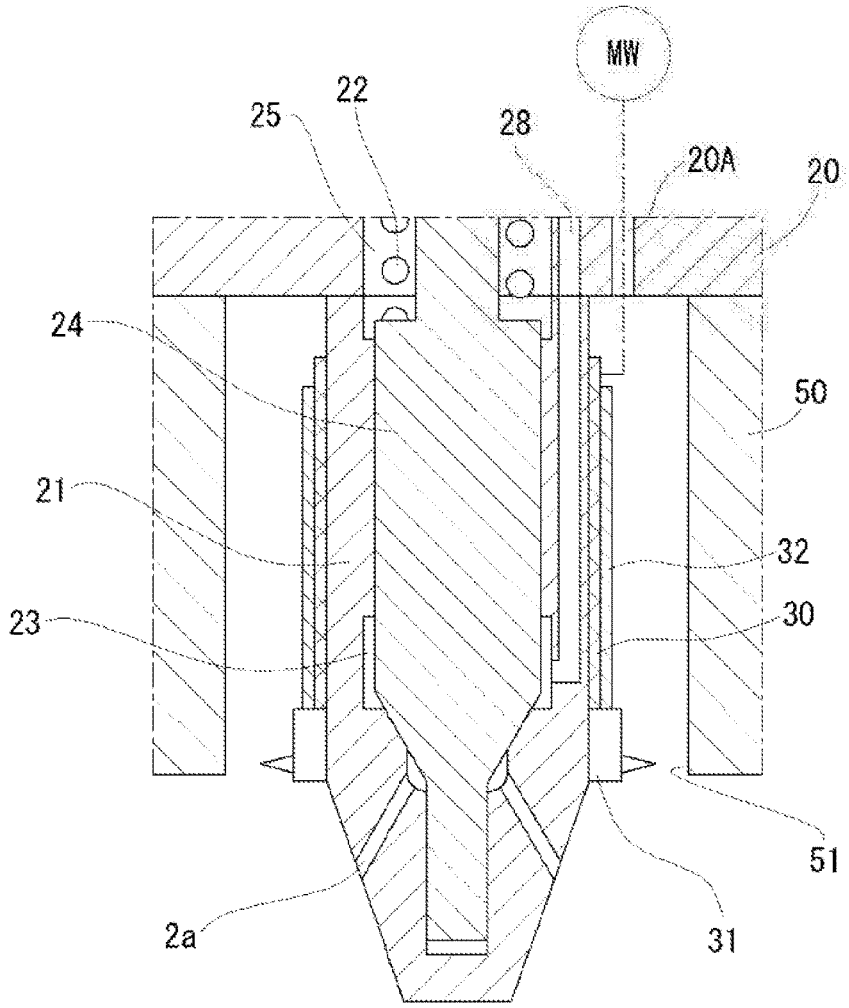
FIG. 6 is an enlarged view of the main part of the injector with the built-in ignition device.

The second embodiment relates to an injector 1B with a built-in ignition device (in below, it may only be referred to "injector 1B"). The injector 1B has a different resonance structure from the first embodiment as illustrated in FIGS. 5 & 6, and except for this, similar with the injector 1A. Therefore, the similar parts explanation is omitted.

The resonance structure of the ignition device 3 of the present embodiment comprises the dielectric member 30 formed on a surface of the fuel injection pipe 21, and a metal film 32 that covers the surface of the dielectric member 30.

The embodiment is effective when the inner diameter of the smaller diameter part of the mounting port 50 has larger than the outer diameter of the fuel injection pipe 21, and when it is difficult to form capacitor between the inner wall surface 50*a* of the mounting port 50 and the dielectric member 30.

The injector 1B with the built-in ignition device of the second embodiment, as well as the first embodiment, can boost the electromagnetic wave, perform a discharge between the surface of the fuel injection pipe 21 and the wall surface 50 of the mounting port 50, and ignite the fuel injected from the fuel injection port 2*a*. Because of nonuse of an ignition coil, malfunction or damage of the actuator 41 caused by the effect of high voltage from the ignition coil can be prevented. Moreover, the outer diameter length of the device as a whole is not changed from the length of a generally-used injector.

(Third Embodiment)

Figure 7:
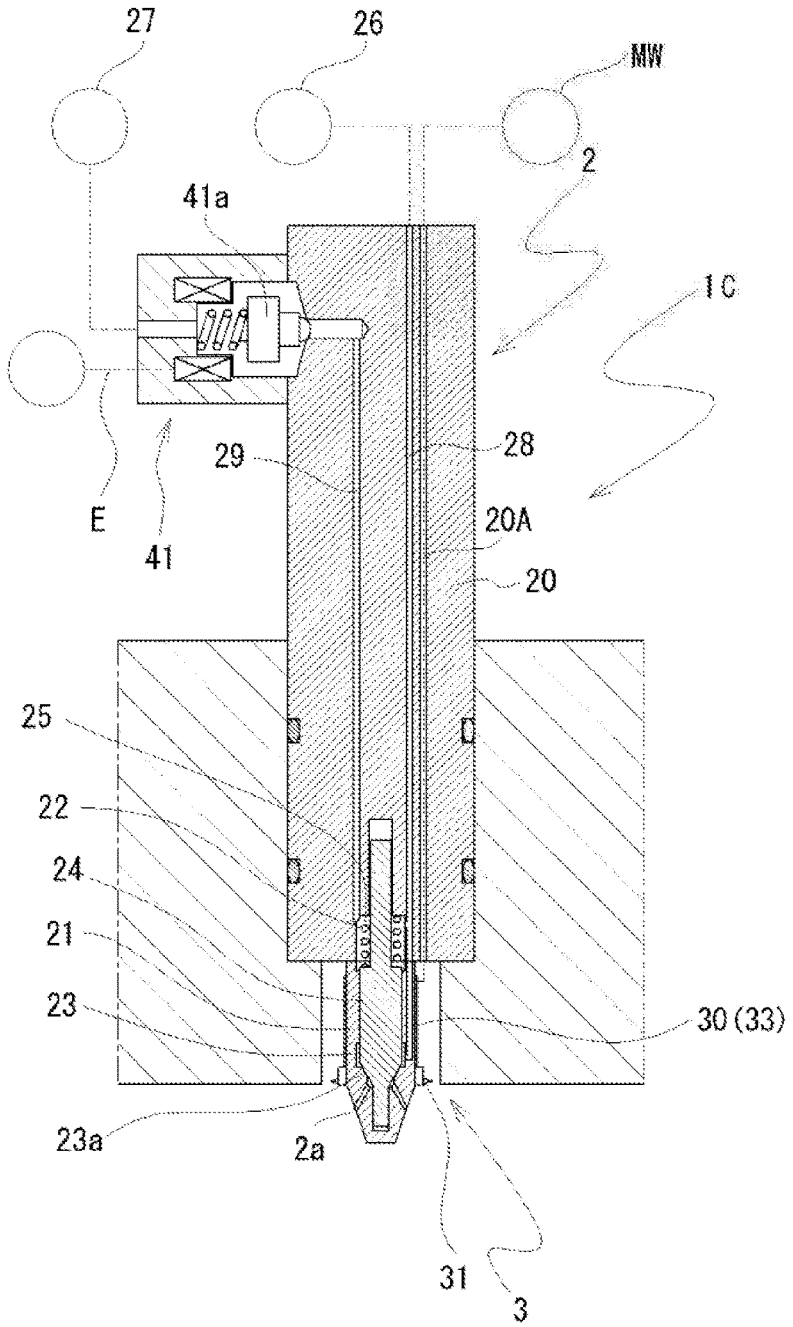
FIG. 7 is a front view of a partial cross section that illustrates an injector with a built-in ignition device of a third embodiment.
Figure 8:
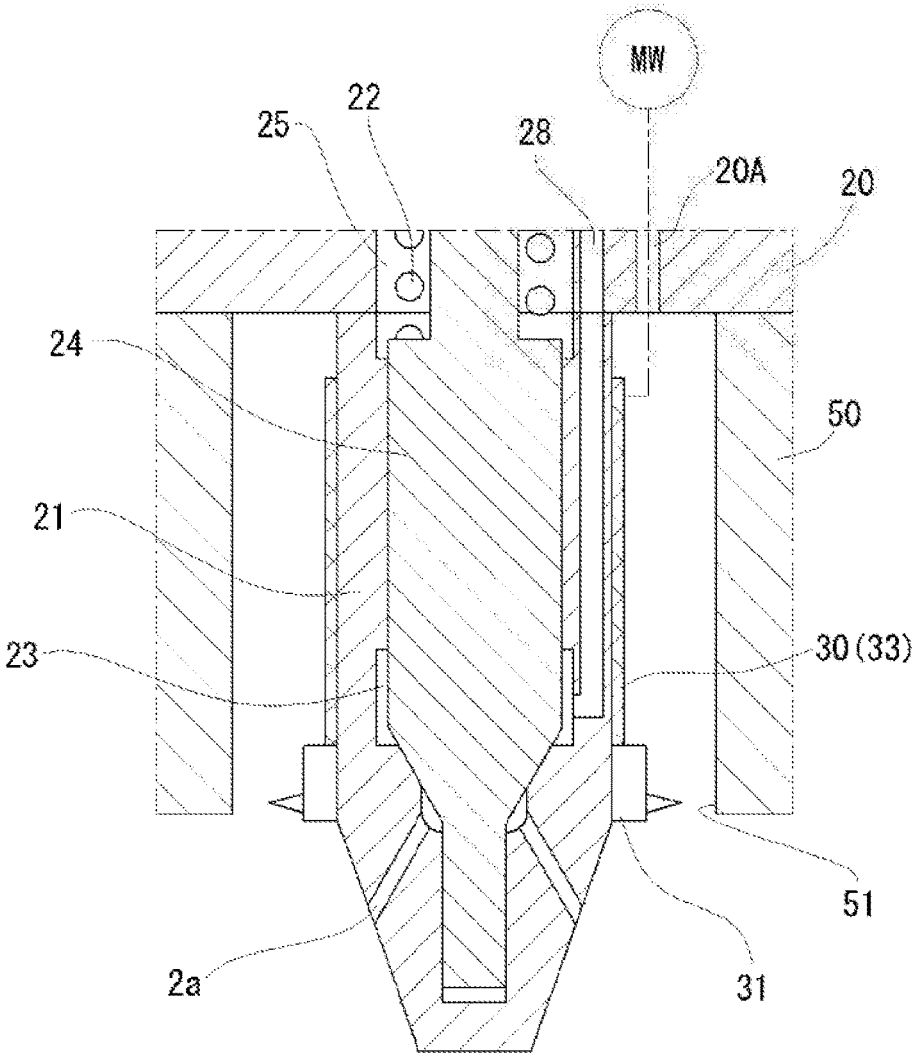
FIG. 8 is an enlarged view of the main part of the injector with the built-in ignition device.

The present third embodiment is an injector 1C with a built-in ignition device of the present invention. In the injector 1C with the built-in ignition device (in below, it may only be referred to "injector 1C"), as illustrated in FIGS. 7 & 8, the structure other than the different resonance structure from the first embodiment is similar with the first embodiment, and the similar parts explanation is omitted.

The resonance structure of the ignition device 3 of the present embodiment uses a dielectric member 33 which has a dielectric constant (relative permittivity) of the dielectric member 30 as more than eight, preferably, more than ten. When the relative permittivity of the dielectric member 30 becomes higher, an inside electric field has a mode other than TEM, i.e., Transverse Electromagnetic Mode. By this, a wave element is produced in a circumferential direction, and the resonation occurs only at the dielectric member 30, and the discharge occurs between the discharge electrode 31 arranged at the tip end of the dielectric member 30 and the ground electrode 51. Structurally, the length of the dielectric member 30 in the axial direction is preferably made shorter than annular length.

As the dielectric member with the relative permittivity having more than eight, barium titanate, i.e., $BaTiO_3$ for example, can be used.

As well as the second embodiment, the present embodiment is effective when the inner diameter of the smaller diameter part of the mounting port 50 is larger than the outer diameter of the fuel injection pipe 21, and when the distance between the inner wall surface 50*a* of the mounting port 50 and the dielectric member 30 is short and the capacitor forming therebetween is difficult.

(Fourth Embodiment)

Figure 9:
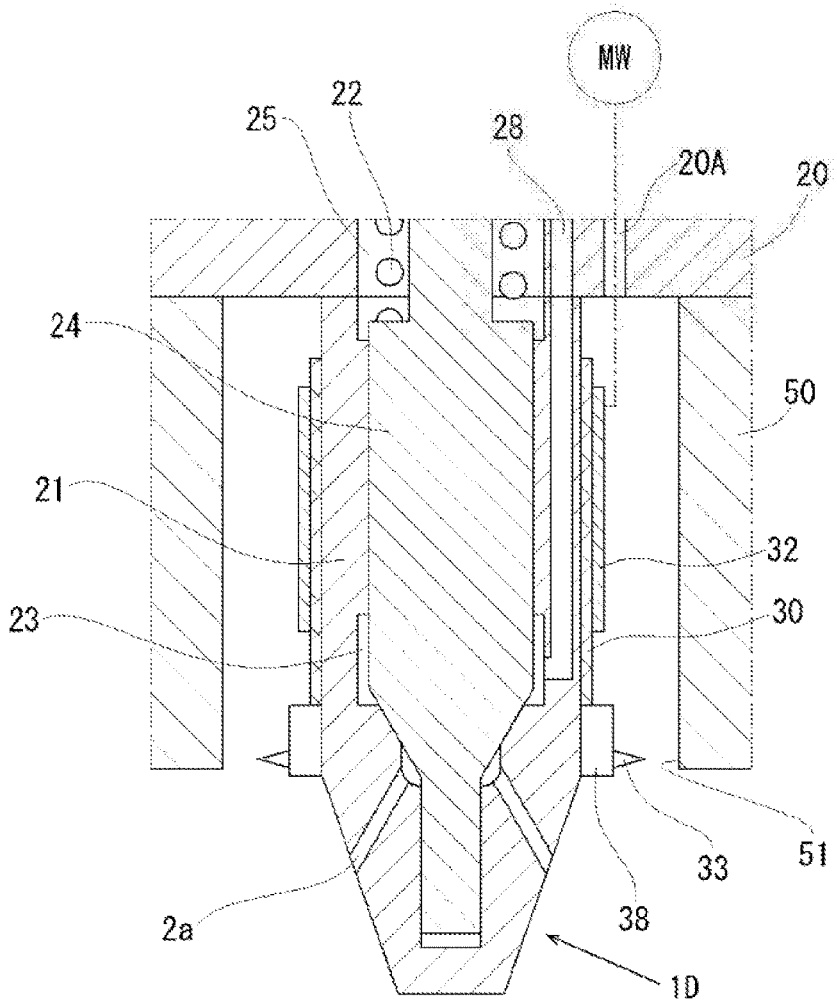
FIG. 9 is a front view of a partial cross section that illustrates an injector with a built-in ignition device of a fourth embodiment.

The fourth embodiment relates to an injector 1D with a built-in ignition device of the present invention (in below, it may only be referred to "injector 1D"). The injector 1D as illustrated in FIG. 9 differs from the second embodiment (referring to FIG. 6) in a point that a part of the dielectric member 30 is not covered by a metal film 32. Moreover, it differs from the second embodiment in that an input of the microwave from the electromagnetic wave oscillator MW is connected to the metal film 32.

Figure 10:
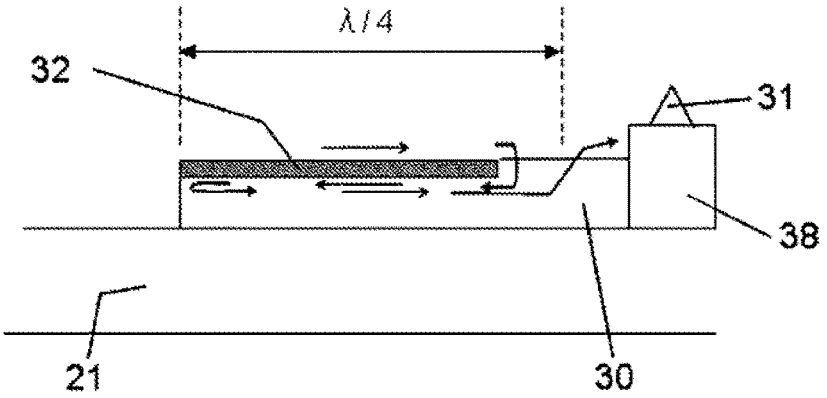
FIG. 10 is a view for illustrating a principle of a microwave amplification of the injector with the built-in ignition device of the fourth embodiment.

FIG. 10 illustrates a principle of the present embodiment. As illustrated, the microwave inputted from the electromagnetic wave oscillator MW is transmitted through the surface of the metal film 32 (from left of the same figure to right). Then, when it reaches to the boundary with the dielectric member 30, the microwave changes its traveling course in reverse, and flows through the boundary between the back surface side of the metal film 32 and the dielectric member 30. Then, when it reaches to a rear end (left end of similar figure) of the dielectric member 30, the microwave again reverses its traveling direction, and flows through the boundary between the back surface side of the metal film 32 and the dielectric member 30. Then, it reaches to the discharge electrode 31 by passing through the conductor metal ring 38.

A part that is not covered by the metal film 32 exists in the dielectric member 30. If the length from center of the part that is not covered by the metal film 32 to the rear end of the dielectric member 30 is set to become ¼ wavelength of the microwave, one kind of resonance phenomenon caused by an interference between traveling wave and reflected wave occurs, and thereby, the microwave is boosted. In other words, lamination structure of the dielectric member 30 and the metal film 32 can form a resonance circuit.

—Modification Example of Fourth Embodiment—

Figure 11:
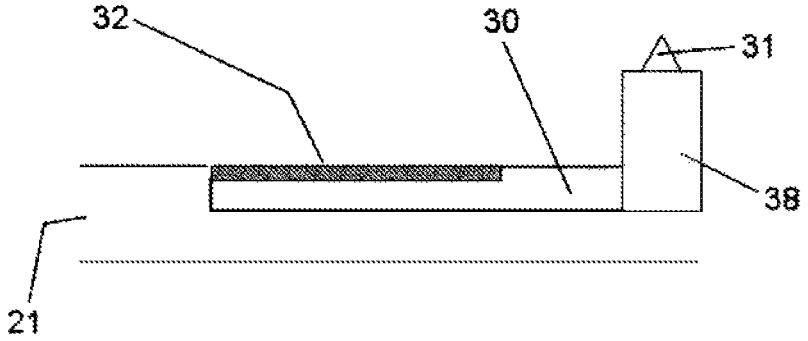
FIG. 11 is a schematic view that illustrates a part of the injector with the built-in ignition device regarding a modification of the fourth embodiment.

In alternative of forming on the surface of the fuel injection pipe 21 the dielectric member 30 and the metal film 32 in this order without any processing thereon, as illustrated in FIG. 11 for example, the surface of the fuel injection pipe 21 may be cut out, a recess portion may be formed, and the dielectric member 30 and the metal film 32 may be constituted in the cut recess portion. In this case, it can be considered that the boundary part of the rear end side of the dielectric member 30 and the fuel injection pipe 21 is a secured end, and the part that is not covered by the metal film 32 of the dielectric member 30 is a free end. Therefore, if the length from the center of the part that is not covered by the metal film 32 of the dielectric member 30 to the rear end of the dielectric member 30 is $\lambda/(4n)$ ($\lambda$=wavelength of the microwave, n=refraction constant of the dielectric member), Q factor becomes larger and the voltage of the microwave can be amplified efficiently.

Figure 12:
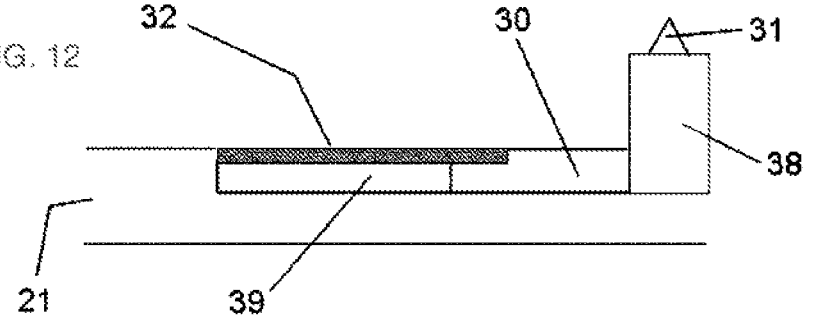
FIG. 12 is a schematic view that illustrates a part of the injector with the built-in ignition device regarding another modification of the fourth embodiment.

Moreover, as illustrated in FIG. 12, the dielectric member 30 may be formed at only a part of the recess portion. The numeral symbol 39 of the same figure indicates "air". According to such a structure, the strength is weaker than the case of FIG. 11, but Q factor of the microwave at the frequency f can become larger, and it is effective from the viewpoint of the boosting of the microwave.

(Fifth Embodiment)

Figure 13:
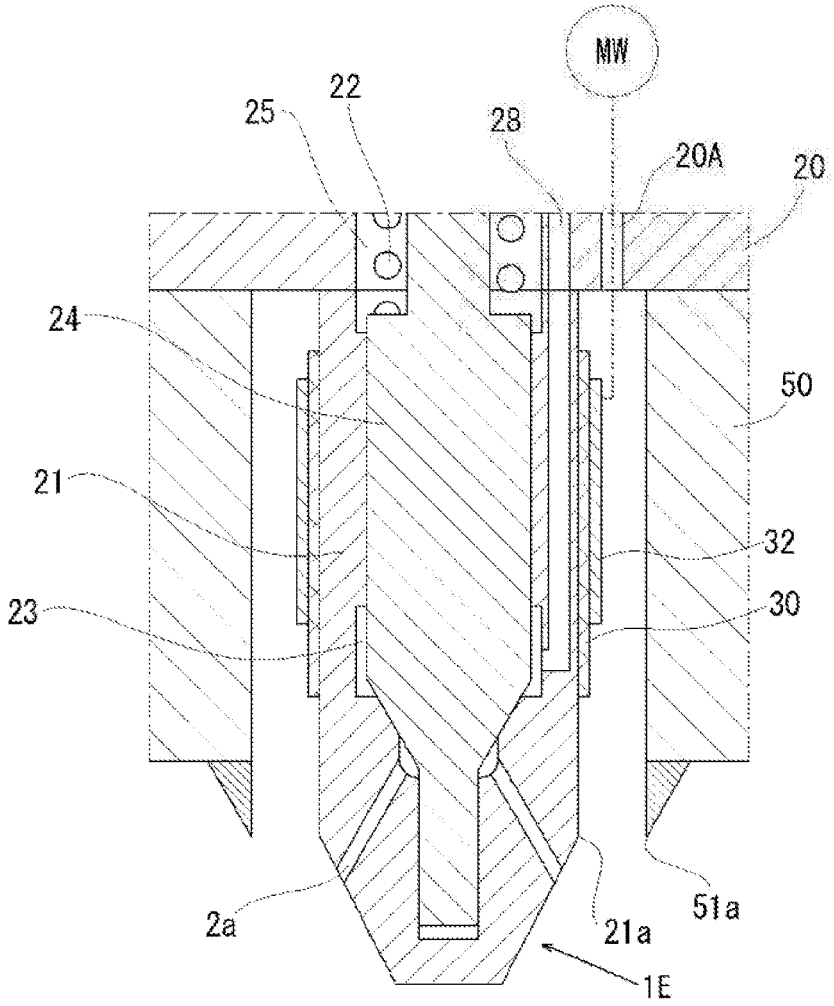
FIG. 13 is a view that illustrates a tip end of an injector with a built-in ignition device of a fifth embodiment.

The fifth embodiment relates to an injector 1E with a built-in ignition device of the present invention (it may only be referred to "injector 1E"). The injector 1E, as illustrated in FIG. 13, includes a cone-shape ground electrode 51 on the bottom of the mounting port 50 of the cylinder head. Then, the discharge is caused between the ground electrode 51 and the projection 21*a* of the fuel injection pipe 21. According to the present embodiment, the discharge can be caused in the vicinity of a fuel injection nozzle (injection port) 2*a*, and therefore, the fuel ignition performance enhancement can be achieved.

(Sixth Embodiment)

Figure 14:
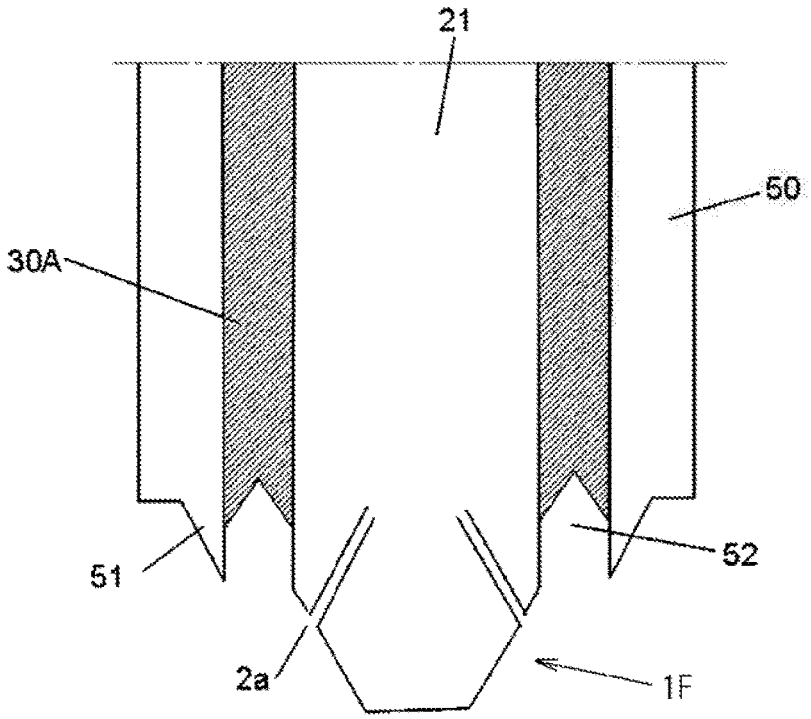
FIG. 14 is a schematic view of the tip end of an injector with a built-in ignition device of a sixth embodiment.

The sixth embodiment relates to an injector 1F with a built-in ignition device of the present invention (in below, it may only be referred to "injector 1F"). In the injector 1F, as illustrated in FIG. 14, a whole space between the injector 1 and the mounting port 50 of the cylinder head is filled with ceramic 30A. Thereby, sealing (air-tightness) effect can be obtained. Moreover, a groove is formed at the bottom surface side, and thereby, so called "hi-pot" (withstanding high voltage) performance can be strengthened.

(Seventh Embodiment)

The seventh embodiment relates to an injector 1G with a built-in ignition device of the present invention (in below, it may only be referred to "injector 1G"). By referring to FIG. 16, the resonance structural part (booster) formed by the dielectric member 30 and etc, and the coaxial cable (generally, 50Ω type) that transmits the microwave from the electromagnetic wave oscillator MW have respective different impedances, and therefore, an impedance matching circuit 45 configured to attain an impedance matching is required to be interposed between the resonance structural part and the coaxial cable. If the impedance matching is not attained, the microwave that transmits through the coaxial cable is reflected at the resonance structural part, and a desirable boosting cannot be performed by the resonance structural part. Moreover, the microwave is reflected at a connection point of the coaxial cable and the resonance structural part, and thereby, heat generation may occur at the connection point. Further, a negative effect due to the turn-back of the reflected wave into the oscillator MW, may occur.

Figure 15:
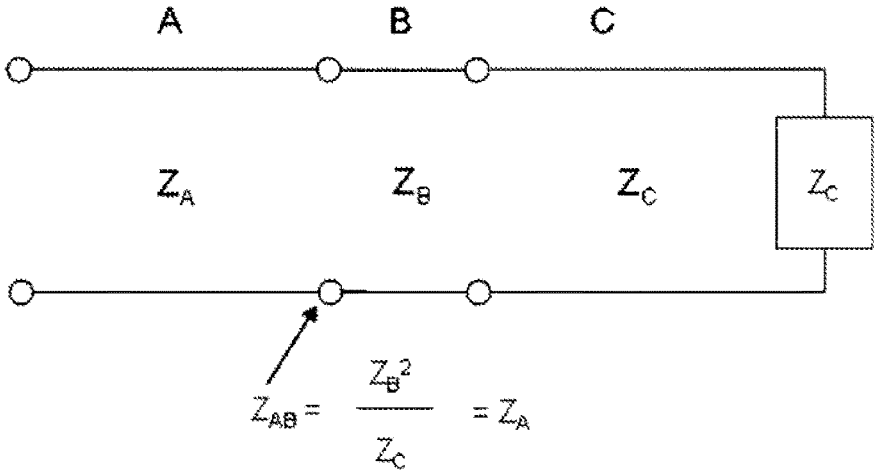
FIG. 15 is a view for illustrating a principle of an impedance matching of an injector with a built-in ignition device of a seventh embodiment.

By referring to FIG. 15, an impedance matching is explained. Now, supposing a line C to which a load equivalent to a characteristic impedance $Z_C$ is connected exists, and thereto another line A having a characteristic impedance $Z_A$ is connected. Here, if the line A is directly connected to the line C, a reflective coefficient Γ at the connection point becomes as the mathematical formula 3, the coefficient is not zero, and therefore, the reflection occurs.

$$\Gamma = \frac{Z_C - Z_A}{Z_C + Z_A} \quad \text{(formula 3)}$$

Then, another line B is prepared for, the characteristic impedance becomes $Z_B$, the length becomes ¼ wavelength (or odd multiple thereof), and the line B is entered between the lines A and C. Then, the impedance $Z_{AB}$ that is seen at the left end side of line B toward right, is expressed in the mathematical formula 4.

$$Z_{AB} = \frac{Z_B^2}{Z_C} \quad \text{(formula 4)}$$

Here, if $Z_B$ is selected such that $Z_A$ is equal to $Z_A$. i.e., an impedance seen at the left end side of line B toward right becomes equal to an impedance seen at the left end side of line B toward left, the reflection at the connection point of A and B becomes zero. As a result, an input impedance of the left end of the line A becomes $Z_A$, and the impedance matching is attained. At that time, $Z_B$ is expressed in the mathematical formula 5.

$$Z_B=\sqrt{Z_A Z_C} \quad \text{(formula 5)}$$

It is considered that the principle above is applied to the injector with the built-in ignition device. The coaxial cable corresponds to the line A. The part composed of the line C and the load at the terminal end is supposed to be the resonance structural part. Here, supposing the impedance of the coaxial cable is 50Ω and the impedance at the resonance structural part (line part as above and together with the load part) is 10Ω, the matching circuit 45 having about 22Ω based on the formula 3 may be interposed therebetween.

Figure 16:
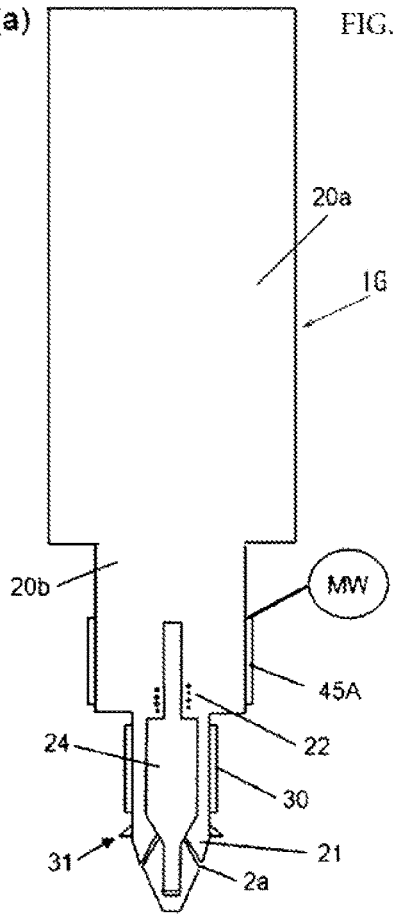
FIGS. 16 (*a*) and (*b*) are a front view of a partial cross section that illustrates the injector with the built-in ignition device of the seventh embodiment.
Figure 16:
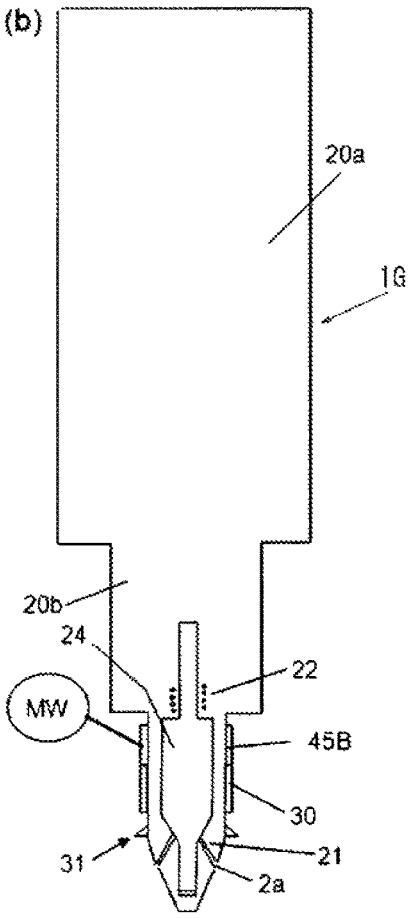

An arranging example of the matching circuit 45 is illustrated in FIG. 16. (a) is an example that illustrates the matching circuit 45A mounted to the center part 20*b* of the main body part 20 (outer wall of a part for housing a biasing means 22 into).

(b) is an example that the matching circuit 45 is mounted directly on the dielectric member 30. If the dielectric member 30 is composed by a material that has a high dielectric constant, the resonance structure can be formed by smaller volume. Therefore, the matching circuit 45B can be positioned by utilizing remaining part at the side wall of the fuel injection pipe 22. The matching circuit 45B can include a plurality of dielectric members that have different dielectric constants, for example. By changing an area of each dielectric member, a gap between the dielectric members (distance) in arbitrary, a desirable impedance characteristic can be obtained.

Note that, in alternative to extend along the outer wall of the main body part 20, a hole may be provided separately in order to penetrate a cable 46 through the cylinder head. Moreover, the cable 46 may be penetrated through a through-hole 20A of the main body part 20.

As described as above, the matching circuit 45 is formed by combination of a resistance element R, inductance L, and capacitance C in an electric-circuit manner. Structurally, it can be formed by, for example, a dielectric member that has a predetermined dielectric constant and size.

—Modification of Seventh Embodiment—

In the above embodiment, functions of the dielectric member 30 and the impedance matching circuit 45 are divided into respectively the booster configured to boost the microwave, and the circuit configured to attain the impedance matching; however, specifically dearly the functions may not be divided into, both of them may have the boosting function and impedance matching function. Conversely, the impedance matching function may be performed by the dielectric member 30 arranged closely to the fuel injection port, and the boosting function may be performed by the matching circuit 45 arranged at further far position from the fuel injection port. Note that, the matching circuit 45 that specializes in attaining an impedance matching as the above embodiment may preferably be provided from the viewpoint of the design facility.

Further, if a cable 46 that has an impedance similar with that of the resonance structural part is selected, the above matching circuits 45A, 45B can be omitted. That is because if $Z_A=Z_C$ is substituted in the formula 1, the reflective coefficient Γ becomes zero, and thereby, the reflection does not occur at the boundary of the cable and the resonance structural part. Accordingly, if it is difficult to arrange the matching circuit 45 in the center part 20*b* of the main body part or on the side wall of the fuel injection pipe 21, selection of such cable is also effective.

It is also effective to select the cable 46 that has an impedance having a value nearly the impedance of the resonance structural part. Thereby, the impedance value of the matching circuit 45 can be reduced, and eventually, the area of the matching circuit 45 can be suppressed smaller.

Figure 34:
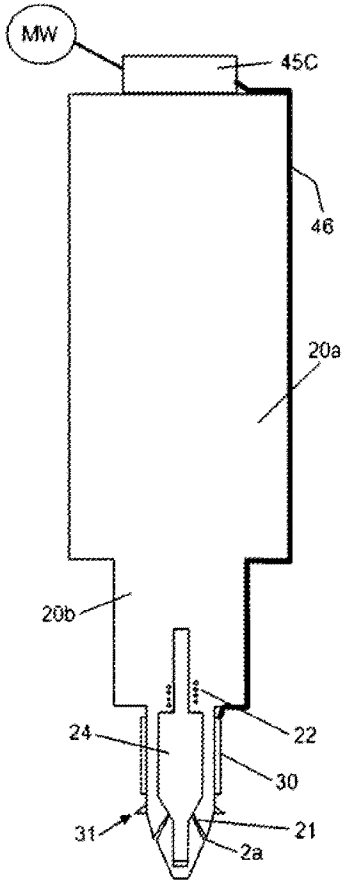
FIG. 34 is a front view of a partial cross section of an injector with a built-in ignition device regarding a modification of the seventh embodiment.

The structure other than FIG. 15 can also be considered. FIG. 34 is an example that a matching circuit 45C is provided at upper further than a position where the actuator is housed inside of the upper part 20*a* of the main body part 20. The cable 46 that extends along the outer wall of the main body part 20 connects from the matching circuit 45C to the dielectric member 30. In this example, a combining impedance of the cable 46 with the resonance structural part corresponds to the line C (and load) in FIG. 15, and therefore, the matching circuit 45C is required to be designed in consideration into the combining impedance. Moreover, for example, an electromagnetic wave transmission line path such as a micro-strip-line is provided on the outer wall of the main body part 20, and the impedance of the transmission line path is set to be a proper value, and thereby, the function of the matching circuit 45 may be performed by the electromagnetic wave transmission line path.

Moreover, the structure as below-described in fifteenth embodiment (Injector 1M with a built-in ignition device, FIG. 29) can be considered.

Furthermore, the coaxial cable and the micro-strip-line may be used together. For example, in the main body part 20, the microwave may be transmitted via the micro-strip-line at more downward side than the O-ring arranged position, the microwave may be transmitted via the coaxial cable at more upward side than the O-ring, and a through-hole may be provided at more upward position than the O-ring.

(Eighth Embodiment)

Figure 17:
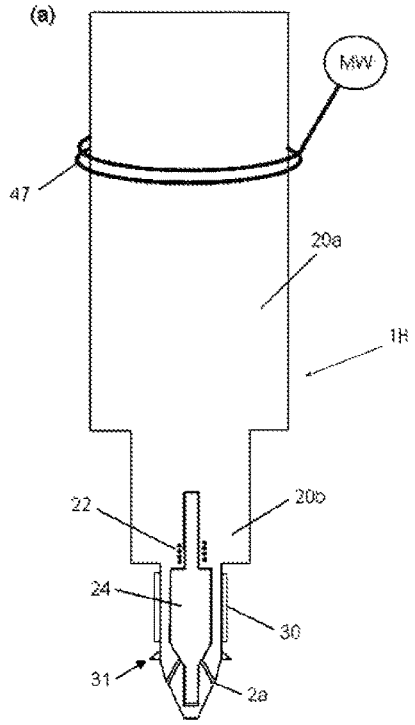
FIGS. 17 (*a*) and (*b*) are a front view of a partial cross section that illustrates an injector with a built-in ignition device of an eight embodiment.
Figure 17:
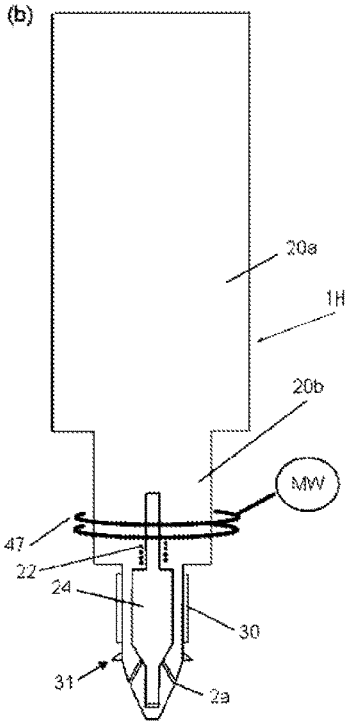

The eighth embodiment relates to an injector 1H with a built-in ignition device of the present invention (in below, it may only be referred to "injector 1H"). As illustrated in FIG. 17, a coil 47 is provided around the outer circumference of the main body part 20 that is formed by the metal conductor, and the microwave from the electromagnetic wave oscillator MW is transmitted by using an inductive coupling between the coil 47 and the main body part 20. Simultaneously, the impedance matching with the MW oscillator can be attained. It is considered that the coil 47 length is ¼ wavelength of the microwave as an example; however, taking into consideration of the impedance matching, other length may be selected.

The microwave transmitted to the outer circumference of the main body part 20 is passed along the outer circumference of the main body part 20 based on, so called "skin effect", and transferred to the dielectric member 30. Note that, although not illustrated, a ceramic dielectric member for aiming to insulate, is mounted on either one of the surface of the main body part 20 and the inner wall of the mounting port 50, or both of them, in order that the microwave is prevented from flowing into the inside wall side of the mounting port 50. At that time, the dielectric member may be mounted on a position where the coil 47 is wounded around, and the microwave may be transmitted toward the main body part 20 by the capacitive coupling.

Further, an insulating cable may transmit the microwave to the dielectric member 30. Note that, if the space is formed between the outer wall of the main body part 20 and the inner wall of the mounting port 50, the above ceramic dielectric member may be unnecessary.

Note that, FIG. 17(*a*) is an example that a coil 47 wounds around the upper part 20*a* of the main body part 20, i.e., position where the piezoelectric actuator is housed inside, if the injector 1 is a piezoelectric injector. FIG. 17(*b*) is an example that the coil 47 wounds around the center part 20*b* of the main body part 20. i.e., position where the biasing means 22 is housed inside.

Moreover, generally, the O-ring is provided on the outer circumference of the injector 1 in order that gas in the combustion chamber is prevented from leaking to outside from the between the outer wall of the injector 1 and the inner wall of the mounting port 50. It is considered that there is a space between the outer wall of the injector 1 and the mounting port 50 at the more downward than the arranging position of the O-ring. Therefore, if the coil 47 wounds at the more downward than the arranging position, the ceramic dielectric member may be omitted at the more downward than the arranging position.

(Ninth Embodiment)

Figure 18:
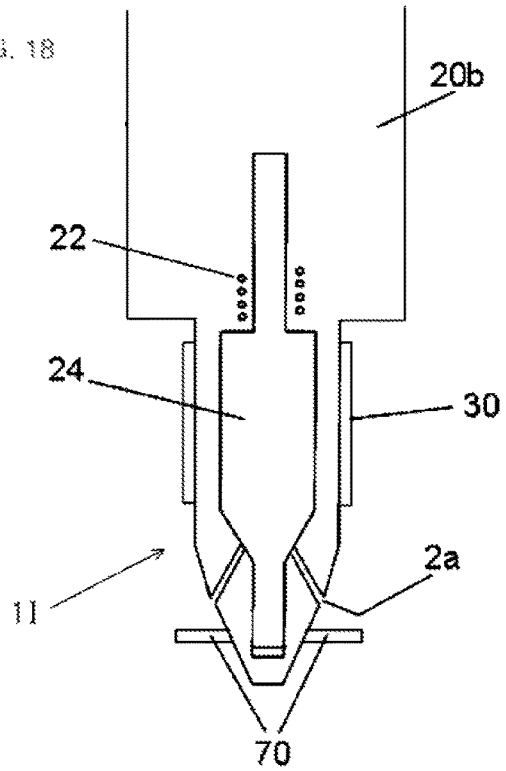
FIG. 18 is a front view of a partial cross section that illustrates an injector with a built-in ignition device of a ninth embodiment.

The ninth embodiment relates to an injector 1I with a built-in ignition device of the present invention (In below, it may only referred to "injector 1I"). In replace of the discharge electrode 31 that is projection formed on the surface of the fuel injection pipe 21, in the present embodiment, as illustrated in FIG. 18, a discharge member 70 in a ring type is provided at the tip end of the fuel injection pipe 21.

Figure 19:
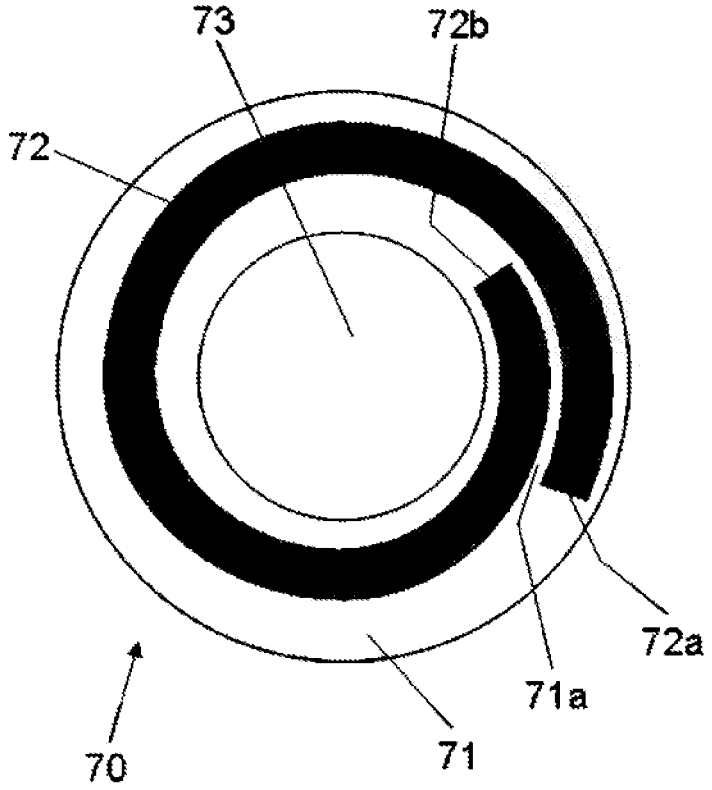
FIG. 19 is a bottom view of a discharge member 70 regarding the injector with the built-in ignition device of the ninth embodiment.

By referring to FIG. 19, the discharge member 70 comprises a ring type substrate 71 composed of a ceramic material and a wounded conductor 72 that is mounted on the bottom of the substrate (surface positioned at the combustion chamber side). The conductor 72 is composed of tungsten, copper, or alloy of them. The length of the conductor, i.e., the length from a start end 72*a* to a terminal end 72*b*, is about ¼ wavelength of the microwave, and it is formed in spiral form such that the terminal end 72*b* and the start end 72*a* are closely positioned together. It is designed or adjusted such that node of the microwave inputted into the conductor 72 is positioned at the start end 72*a*, and anti-node thereof is positioned at the terminal end 72*b*. Thereby, the potential difference between the terminal end 72*b* and the start end 72*a* can be largest, and the discharge can be caused at a substrate surface 71*a* between the terminal end 72*b* and the start end 72*a*. Note that, the transmission of the microwave between the conductor 72 and the dielectric member 30 is performed by wired connection, micro-strip-line, or wireless connection.

A protection substrate composed of such as ceramics or glass may further be provided on bottom surface side of the substrate 71 to which the conductor 72 is mounted, in order to protect the conductor 72 from the viewpoint of heat damage, or prevent fuel from adhering. In this case, the protection substrate is not provided in the vicinity of the surface 71*a* where the discharge is performed, and the protection substrate is preferably provided at other parts.

Moreover, in alternative to mount the conductor 72 on the bottom surface of the substrate 71, the conductor 72 may be mounted at the top surface side of the substrate 71. Or, the conductor 72 may be embedded into the substrate 71.

—Modification of Ninth Embodiment—

Figure 20:
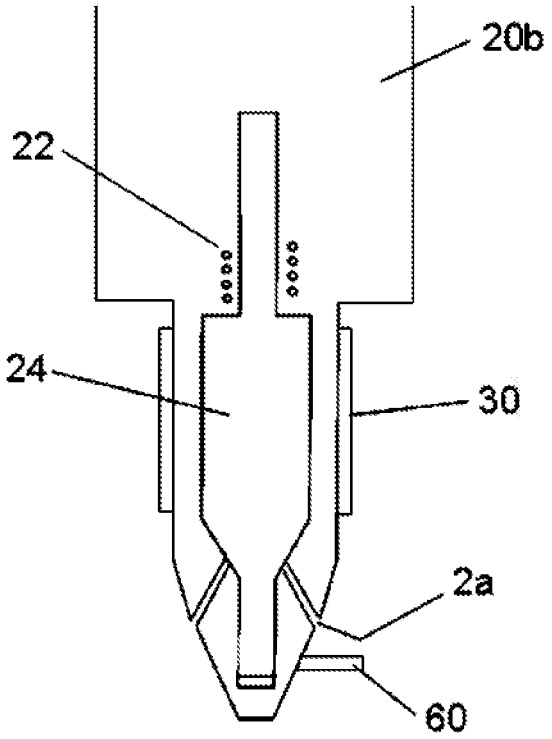
FIG. 20 is a front view of a partial cross section that illustrates an injector with a built-in ignition device regarding a modification of the ninth embodiment.
Figure 21:
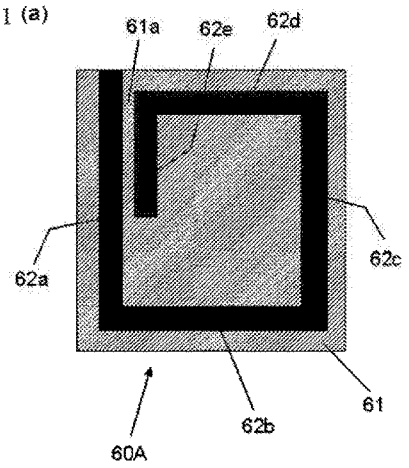
FIGS. 21 (*a*) and (*b*) are a bottom view of a discharge member 60 regarding the injector with the built-in ignition device regarding the modification of the ninth embodiment.
Figure 21:
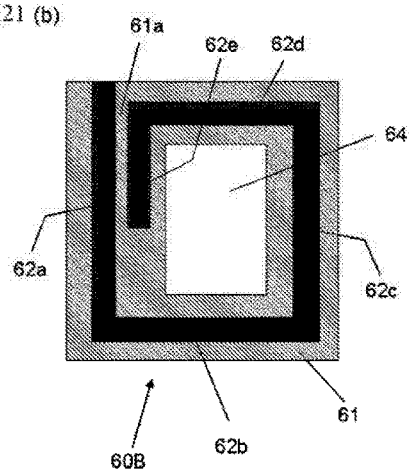

As illustrated in FIGS. 20 and 21, in alternative to the ring type discharge member 70, a rectangular discharge member 60 may be mounted on. The discharge member 60 is mounted on the side surface of the tip end of the fuel injection pipe 21.

Shown as an example of FIG. 21(*a*), a conductor 62 is formed on a rectangular substrate 61 that is composed of ceramics material. The microwave is entered from a conductor 62*a* at the start end side, the discharge is caused at a substrate surface 61*a* sandwiched between the start end side conductor 62*a* and a terminal end side conductor 62*c*. The conductor 62 length is set to around ¼ wavelength of the microwave.

Shown as the example of FIG. 21(*b*), a cavity part 64 for passing the fuel injected from the fuel injection port 2*a* through is provided on the center of the rectangular substrate 61. Other parts structure is similar with the example of (a).

Taking into consideration of the dielectric constant of the conductor, ¼ wavelength of the microwave corresponds to about 10 mm. Accordingly, in order to arrange the 10 mm length conductor 72 or 62, a corresponding area (space) is required. Therefore, from a viewpoint that an arrangement in a limited space can be performed it is more effective to use the discharge member 70 by the ring shape substrate 71. However, if the discharge member 70 is used, the size or position needs to be designed or adjusted such that the fuel injection jet flow does not hit directly.

(Tenth Embodiment)

Figure 22:
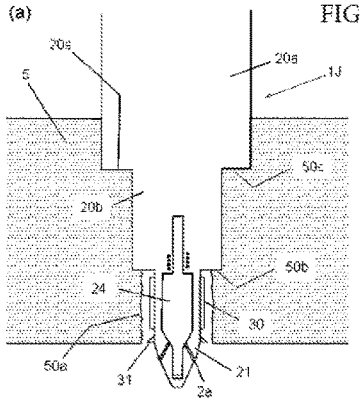
FIGS. 22 (*a*) and (*b*) are a front view of a partial cross section of an injector with a built-in ignition device of a tenth embodiment.
Figure 22:
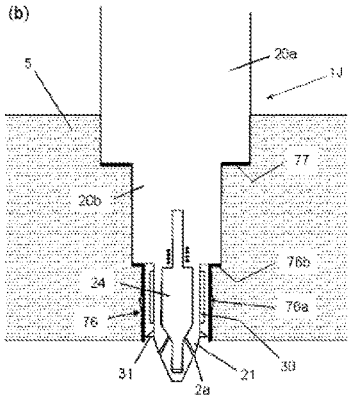

Tenth embodiment relates to an injector 1J with a built-in ignition device of the present invention (in below, it may only be referred to "injector 1J"). As illustrated in FIG. 22(*a*), there may be a case where the inner wall surface 50*a* of the mounting port 50 of the cylinder head 5 has concave-convex for the reason of deterioration with age, thermal deformation, and etc. As a result, there is a risk that a desirable resonance structure cannot be obtained since the distance between the dielectric member 30 formed on the surface of the fuel injection pipe 21 and the inner wall surface 50*a* becomes uneven. Accordingly in the present embodiment, as illustrated in FIG. 22(*b*), a socket member 76 composed of a metal conductor is mounted inside the mounting port 50. The socket member 76 includes a cylindrical member 76*a* that is inserted into the inside of the inner wall surface 50*a*, and an extension part 76*b* that is extended to outside originated from the top part of the cylindrical member 76*a* in perpendicularly intersecting direction with the axial direction and mounted on the step 50*b* of the mounting port 50. By providing the socket member 76, distance to/from the conductor that exists at the state of being opposed to the dielectric member 30 can make even, and therefore, a desirable resonance structure can be maintained or achieved even if the deterioration with age and etc. goes on in the cylinder head.

Note that, by providing the extension part 76*b*, a boundary surface 20*s* of the upper part 20*a* and the center part 20*b* of the main body part 20 of the injector 1 floats from a step 50*c* of the mounting port 50. Therefore, an elastic member 77 may be mounted between the step 50*c* and the boundary surface 20*s*.

Not limited to a case where the concave-convex is generated on the surface of the inner wall surface 50*a*, there may occur a case where the distance between the inner wall surface 50*a* and the surface of the fuel injection pipe 21 is too much larger, and due to the reason, a desirable resonance structure cannot be realized. In this situation, it is effective to use the socket member 76.

In replace of the socket member 76, a cylindrical member that is similar with the cylindrical member 76*a* of the socket member 76 may be mounted on the boundary surface of the main body part 20 and the fuel injection pipe 21.

In alternative to form the dielectric member 30 on the fuel injection pipe 21 of the injector 1, the dielectric member 30 may be formed on the inner wall of the cylindrical member 76*a*.

—Modification of Tenth Embodiment—

Figure 35:
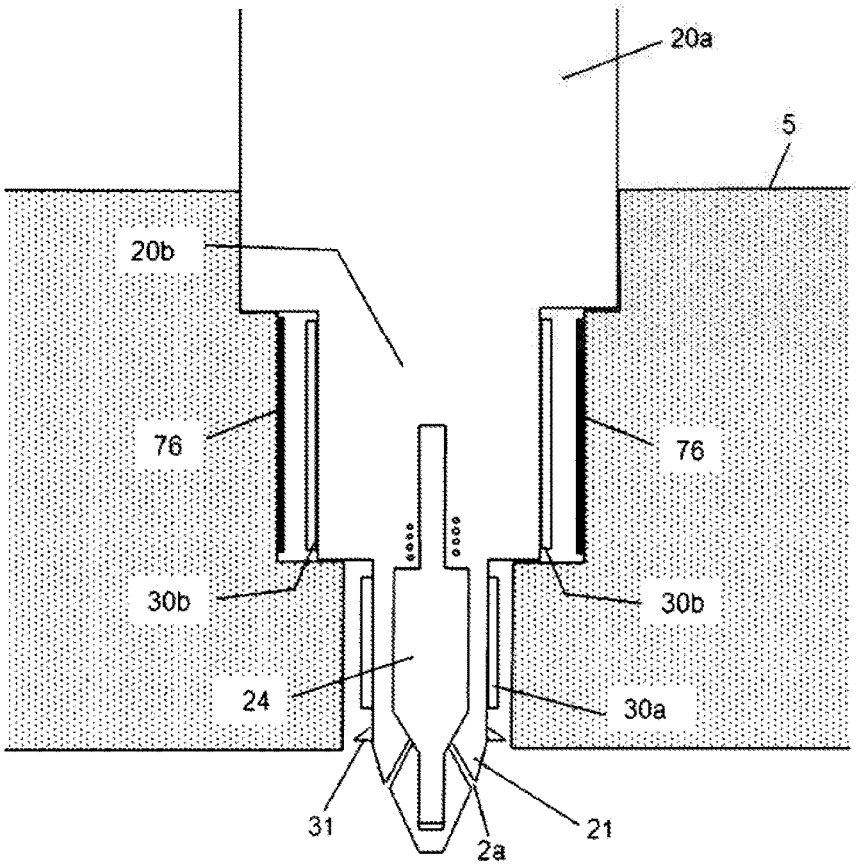
FIG. 35 is a front view of a partial cross section of an injector with a built-in ignition device regarding a modification of the tenth embodiment.

As illustrated in FIG. 35, the dielectric member 30*b* is provided on the outer circumference of the center part 20*b* of the main body part 20 of the injector 1, and on further outside thereof through a space, the socket member 76 may be arranged. As mentioned as above, there is a need to provide the circuit to attain an impedance matching between the resonance structural part and the coaxial cable. The present modification embodiment is an example that realizes the matching circuit by using the dielectric member 30*b* and the socket member 76.

Since there is a need to provide a space between the dielectric member 30*b* and the socket member 76, measures are required, which is, for example, adjustment in diameter of the cylinder head 5 (enlargement of the mounting port 50), or adjustment in diameter of the injector 1 (decreasing the diameter of the center part 20*b* of the main body part 20). Accordingly, the present modification is applied to a new product, i.e., new injector. Note that if the diameter of the mounting port is sufficiently large, the adjustment in diameter of the injector 1 or the adjustment in diameter of the cylinder head 5 for mounting the injector to the mounting port is unnecessary.

(Eleventh Embodiment)

The eleventh embodiment relates to an injector 1K with a built-in ignition device of the present invention (in below, it may only be referred to "injector 1K"). In the above-mentioned embodiments from first through tenth, the discharge electrode 31 is located at more upward than the fuel injection port 2*a*. Put simply it is constituted to perform the discharge on the rear side (upstream side) of the fuel injection port. On the other hand, in the present embodiment, it is constituted to perform the discharge on the front side (downstream side) of the fuel injection port.

Figure 23:
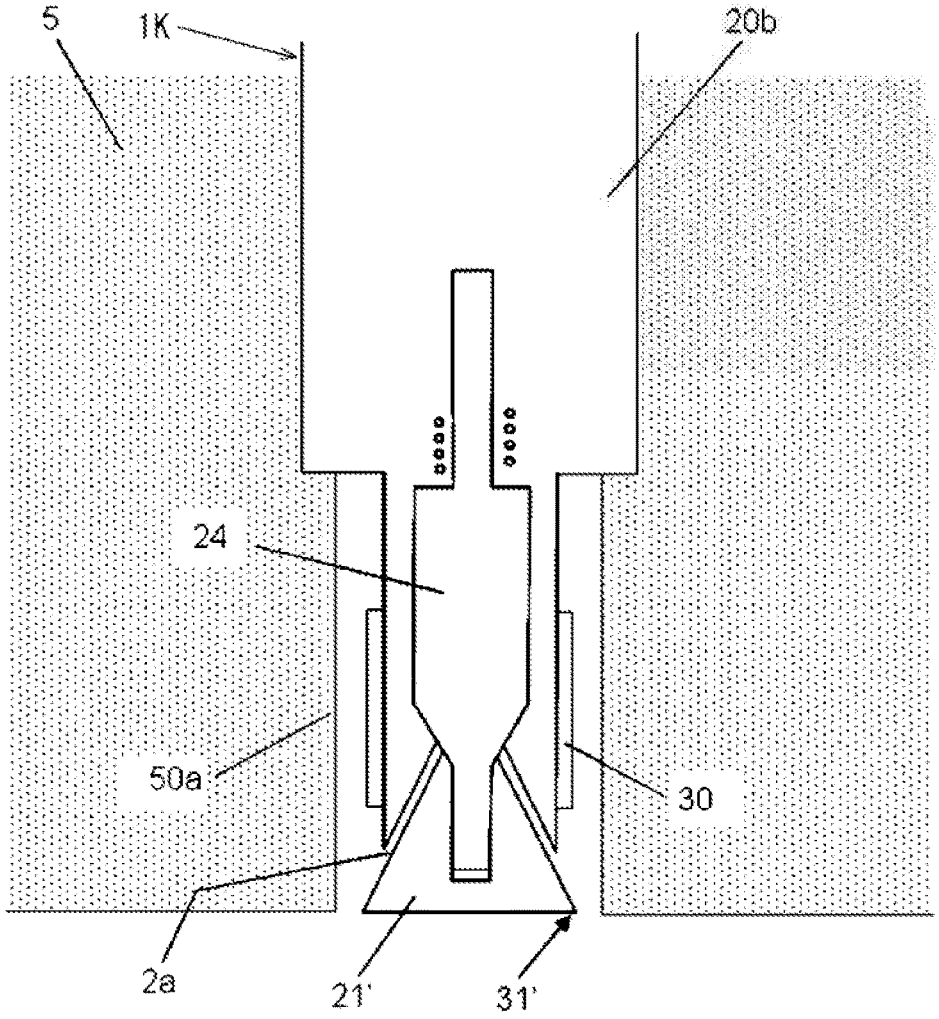
FIG. 23 is a front view of a partial cross section of an injector with a built-in ignition device of an eleventh embodiment.

By referring to FIG. 23, the injector 1K differs in the shape of tip end of the fuel injection pipe 21' from the respective before-described embodiments. In the above embodiments, the diameter of the fuel injection pipe 21 gradually becomes smaller as reaches to the tip end; however, in the present embodiment, the diameter size gradually becomes larger as reaches to the tip end. On the outer circumference of the bottom end of the fuel injection pipe 21', the discharge electrode 31' is formed, and the discharge is performed between the discharge electrode and the inner wall surface 50*a* of the mounting port 50 of the cylinder head 5. Put simply, a structure that the discharge is performed in a position that faces to the combustion chamber is adopted. On the other hand, the fuel injection port 2*a* is located at more upward than the discharge electrode 31', and the fuel is injected from upward of the discharge position.

According to the present embodiment, since the fuel is injected toward the discharge position, an ignition performance improvement can be expected. Moreover, for the reason of adoption of the structure that the fuel injection port 2*a* is arranged closely to a combustion chamber, the length of the outer wall of the fuel injection pipe 21 in a vertical direction can be increased, and an area of the outer wall can be enlarged. Therefore, it is effective to design the resonance structure by using such the dielectric member 30. Moreover, since the distance between the dielectric member 30 and the discharge electrode 31' is preferably shorter (in a case where a design is adopted such that an anti-node of the microwave is located on the bottom end side of the dielectric member 30), as illustrated in FIG. 23, the dielectric member 30 is located at more downward than the cases of embodiments first through tenth. Moreover, by shifting the dielectric member 30 downward, a space room remained in the upper side outer wall of the fuel injection pipe 21 may be used in order that the impedance matching circuit is arranged.

Note that, in embodiments first through tenth, since the discharge electrode is located on the upper part of the fuel injection port, there is an advantage that the fuel amount adhered to the discharge electrode is reduced. Moreover, there is a case where it is better to locate the discharger (ignition device) at the upstream side of a jet stream depending on a fuel type. Accordingly, whether the present embodiment is adopted or not should be determined also by the fuel type for use.

—Modification of Eleventh Embodiment—

Figure 24:
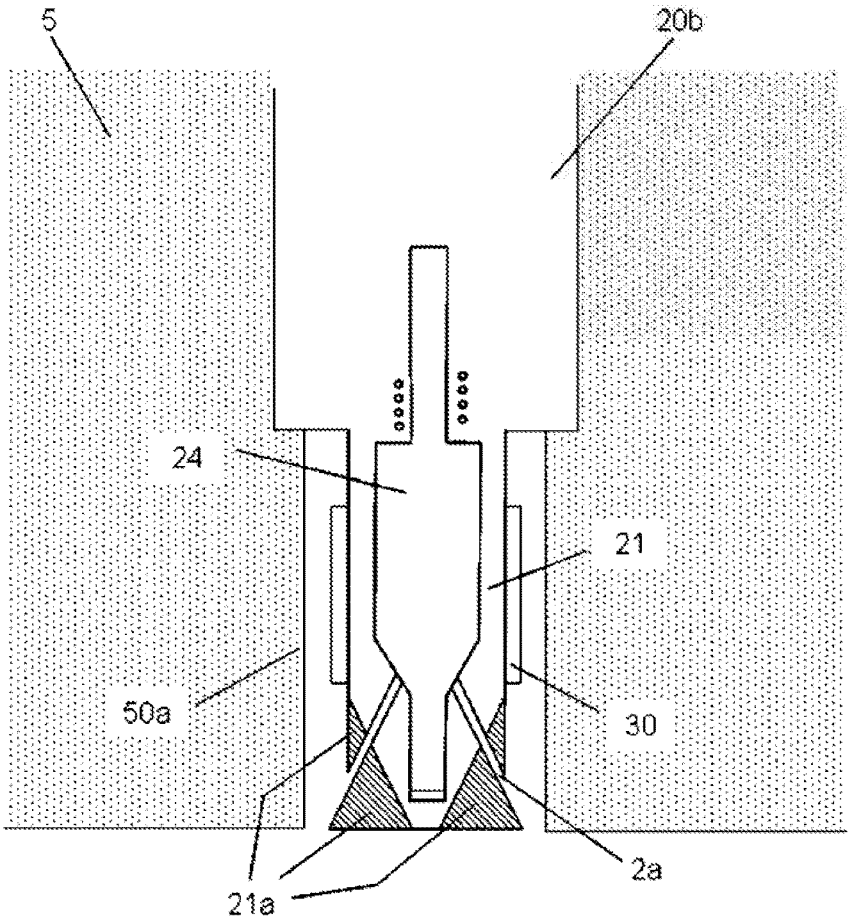
FIG. 24 is a front view of a partial cross section of an injector with a built-in ignition device regarding a modification of the eleventh embodiment.

The fuel injection pipe 21' of the present embodiment may be the one newly designed/manufactured, but, for example, as illustrated in FIG. 24, an extension member 21*a* may be provided on the fuel injection pipe 2. In FIG. 24, although the mounting position of the dielectric member 30 is depicted as similar with first though tenth embodiments for clear explanation of the structure of the extension member 21*a*, in fact, the dielectric member 30 is preferably arranged at the position close to the discharge electrode (fuel injection port 2*a*).

(Twelfth Embodiment)

Figure 25:
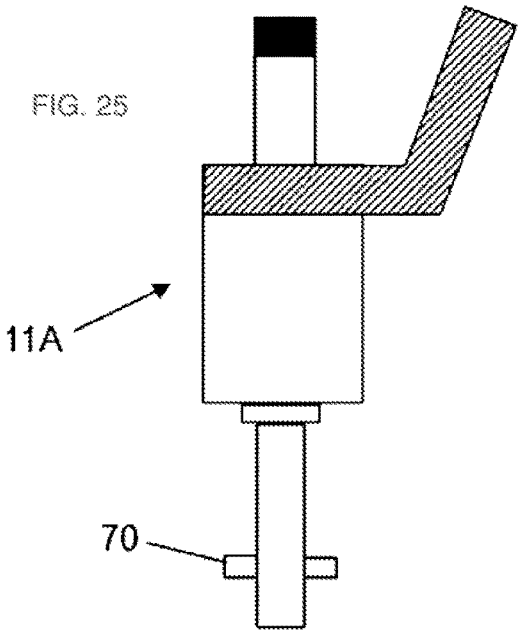
FIG. 25 is a front view of a partial cross section of an injector with a built-in ignition device of a twelfth embodiment.

The twelfth embodiment relates to an injector 11A with a built-in ignition device of the present invention (in below, it may only be referred to "injector 11A"). In the present embodiment, the present invention is applied to a gasoline direct injection engine. By referring to FIG. 25, the discharge member 70 similar with the one in the ninth embodiment is provided in the fuel injection pipe at the tip end.

Figure 26:
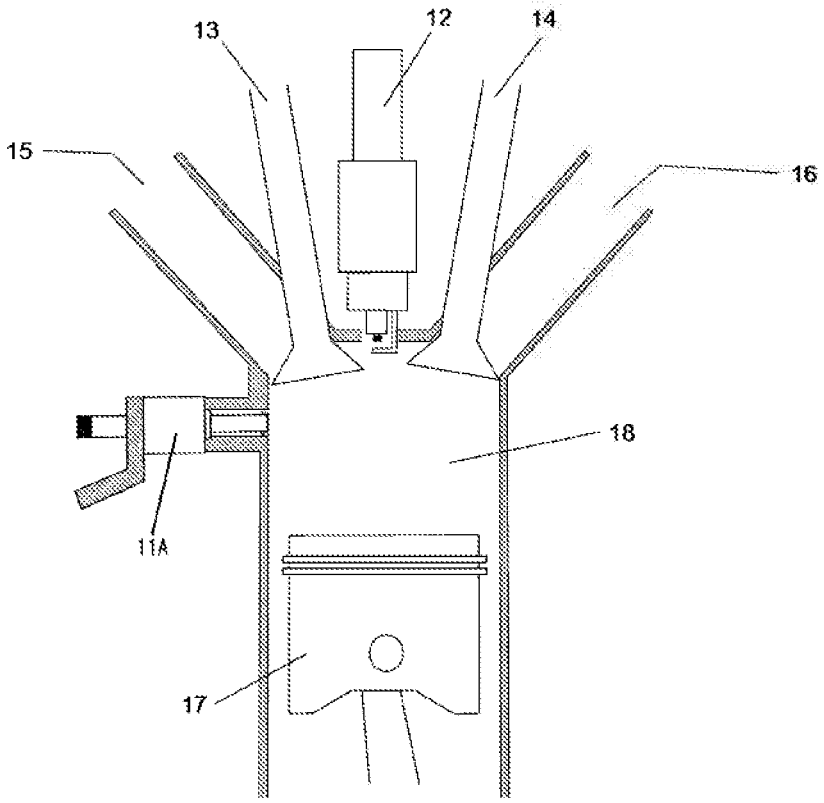
FIG. 26 is a front view of a partial cross section that illustrates an example of applying the injector with the built-in ignition device of the twelfth embodiment to a gasoline engine as a direct injection injector.

FIG. 26 is an example that illustrates the gasoline direct injection engine mounted with the injector 11A. The injector 11A is mounted on the side part of the combustion chamber. According to the injector 11A, the discharge is performed at the side part of the fuel injection port, and therefore, the fuel that is already ignited and maintained of the ignition state can be injected into the combustion chamber.

Generally, when the direct injection injector is used, positioning of the fuel spray and the spark plug 12 is difficult; however, in the present embodiment, since the fuel that is already ignited is injected, there is an advantage that the positioning becomes easier.

Figure 36:
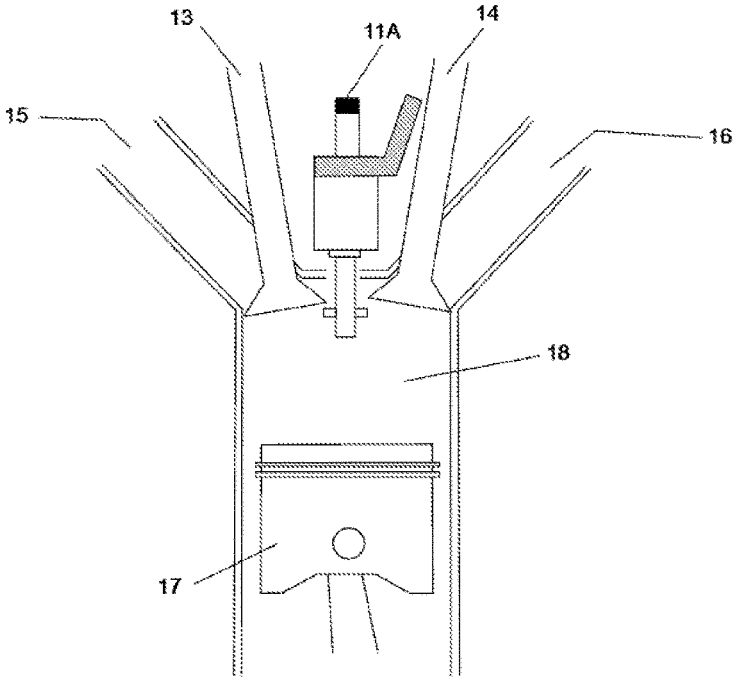
FIG. 36 is a front view of a partial cross section that illustrates an internal combustion engine regarding a modification of the twelfth embodiment.

Moreover, by using the injector 11A, for example, as illustrated in FIG. 36, a gasoline engine that does not include (mount) the general spark plug can be realized.

The discharger may be realized by using means other than the discharge member 70. For example, when a projection amount of the injector toward the combustion chamber is not large, as similar as first through eighth embodiments, the resonance structure may be realized by performing the dielectric member coating on the side surface of the fuel injection pipe of the injector 11A, and discharge to/from the inner wall surface of the cylinder head 5 may be performed by mounting a projected discharge electrode.

In a case where projection amount of the injector 11A is large and the discharge gap cannot be formed to/from the inner wall surface of the cylinder head, as illustrated in FIG. 38, a cylindrical member 78 may be provided at the outside of the fuel injection pipe of an injector 11B, the resonance structure may be formed between the inner wall surface of the cylindrical member and the outer wall surface of the fuel injection pipe, and the discharge may be performed between the discharge electrode 31 and the cylindrical member 78.

Figure 39:
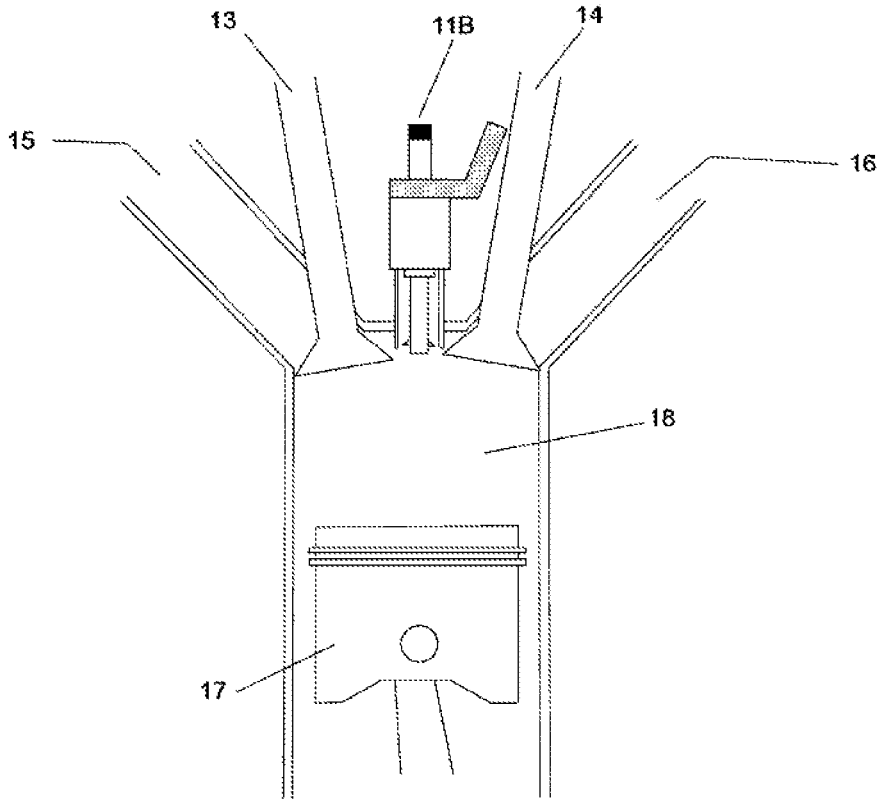
FIG. 39 is a front view of a partial cross section that illustrates an internal combustion engine regarding another modification of the twelfth embodiment.

Moreover, a diameter of the tip part (fuel injection pipe) of the injector for the gasoline direct injection engine, is from 5 mm through 7 mm, for example. On the other hand, almost all of a port diameter of the spark plugs distributed at present is 12 mm. Accordingly, the diameter of the cylindrical member 78 that surrounds around the tip part of the injector coincides with the diameter of the mounting port for, so called M12 type spark plug. In other words, as illustrated in FIG. 39, in replace of the spark plug, the ignition device built-in type injector 11B can be mounted easily. Therefore, the injector 11B is suitable for an alternative product of the spark plug.

In the present embodiment, the injector 11 is mounted to the side wall of the combustion chamber, but the injector 11 may be mounted between the spark plug and the intake valves of the cylinder head or between the spark plug and the exhaust valves of the cylinder head.

(Thirteenth Embodiment)

Figure 27:
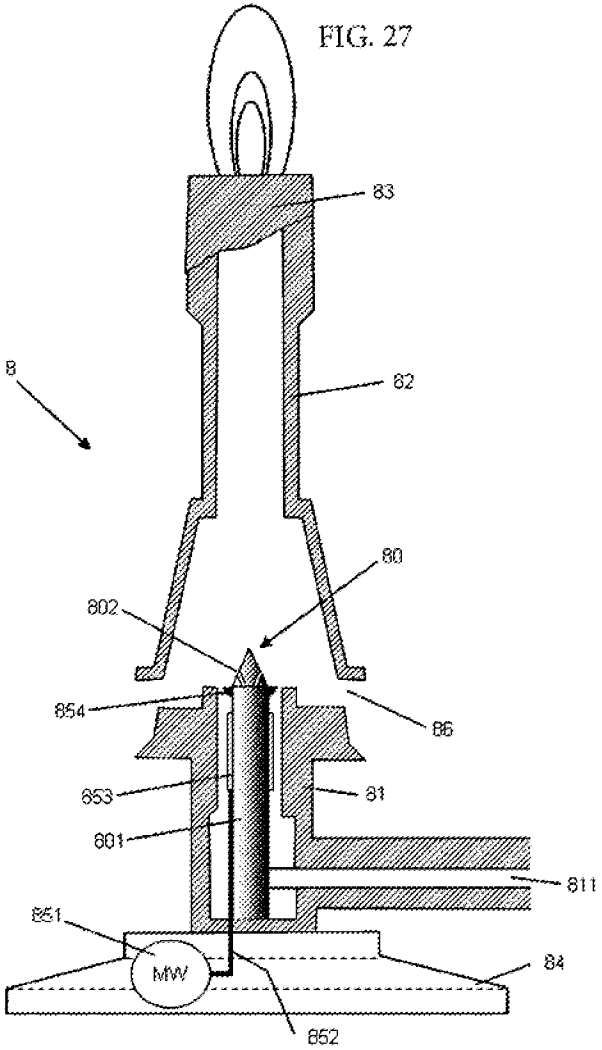
FIG. 27 is a front view of a partial cross section that illustrates a gas burner of a thirteenth embodiment.

The thirteenth embodiment relates to a gas burner 8 of the present invention. By referring to FIG. 27, the gas burner 8 includes an injector 80, a housing member 81 configured to house therein the injector 80, a mixing tube 82 configured to mix the injected fuel from an injection port 802 of the injector 8 with air introduced from an air inlet port 86, a burner head 83, and a holding plate 84 configured to hold the housing member 81.

As well as the embodiments for the above-mentioned injectors, a projection type discharge electrode 854, and a plate type dielectric member 853 are provided on a main body surface 801 of the injector 80. An electromagnetic wave oscillator 851 is housed below the injector 80 and inside the holding plate 84, and the electromagnetic wave (microwave) generated in the oscillator is transmitted to the dielectric member 853 via a cable 852.

Moreover, fuel is introduced into the injector 80 via a fuel path 811 that is provided at the side part of the housing member 81.

The resonance structure of the injector 80 is similar with the respective embodiments of injectors. The electromagnetic wave is boosted by the resonance structure that is constituted of the dielectric member 853 and the inner wall surface of the housing member 81. Thereby, the potential difference between the discharge electrode 854 and the inner wall surface of the housing member 81 is increased, and the discharge is caused therebetween. Combustion can be caused by plasma generated by the discharge, fuel injected from the injection port, and air introduced from the air inlet port 86. By adopting such the structure, the gas burner of the present embodiment can be realized.

In the gas burner of the present embodiment, energy for discharge with usage of the microwave is utilized in addition to the general gas burner, and therefore, combustion can be realized by fuel smaller than as usual amount.

(Fourteenth Embodiment)

Figure 28:
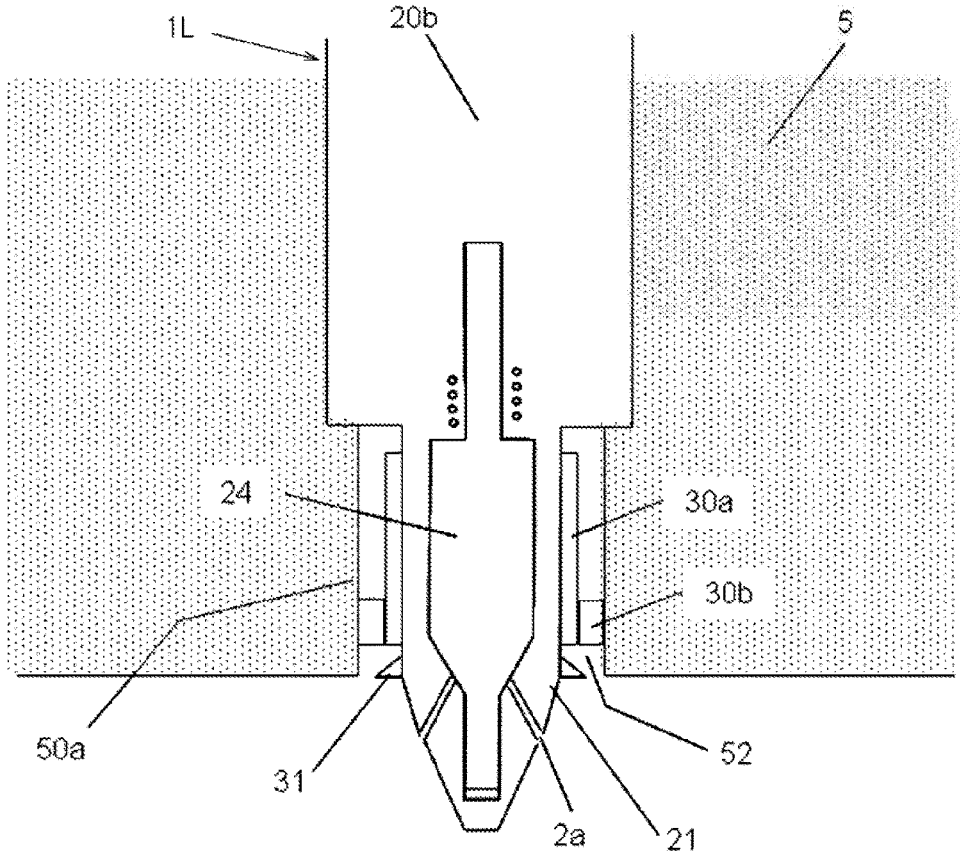
FIG. 28 is a front view of a partial cross section that illustrates an injector built-in an ignition device of a fourteenth embodiment.

The fourteenth embodiment of the present invention relates to an injector 1L with a built-in ignition device (in below, it may only be referred to "injector 1L"). As illustrated in FIG. 28, further dielectric member 30*b* is formed on the dielectric member 30 (in the similar figure, expressed as "30*a*") formed on the surface of the fuel injection pipe 21. Thereby, space between the dielectric member 30*a* and the inner wall 50*a* of the cylinder head 50 may be shielded, i.e., plugged up, and a sub-closed space 52 may be formed on the upper part of the discharge electrode 31. When the discharge from the discharge electrode 31 is caused, the pressure inside the space 52 increases as the temperature becomes higher. Thereby, plasma generated by discharge is injected downward (to the combustion chamber side), and the plasma can be introduced to the vicinity of the fuel injection port 2*a*. In other words, an ignition performance can be enhanced by introducing the plasma to the vicinity of the outlet of the fuel injection part 2*a*.

(Fifteenth Embodiment)

Figure 29:
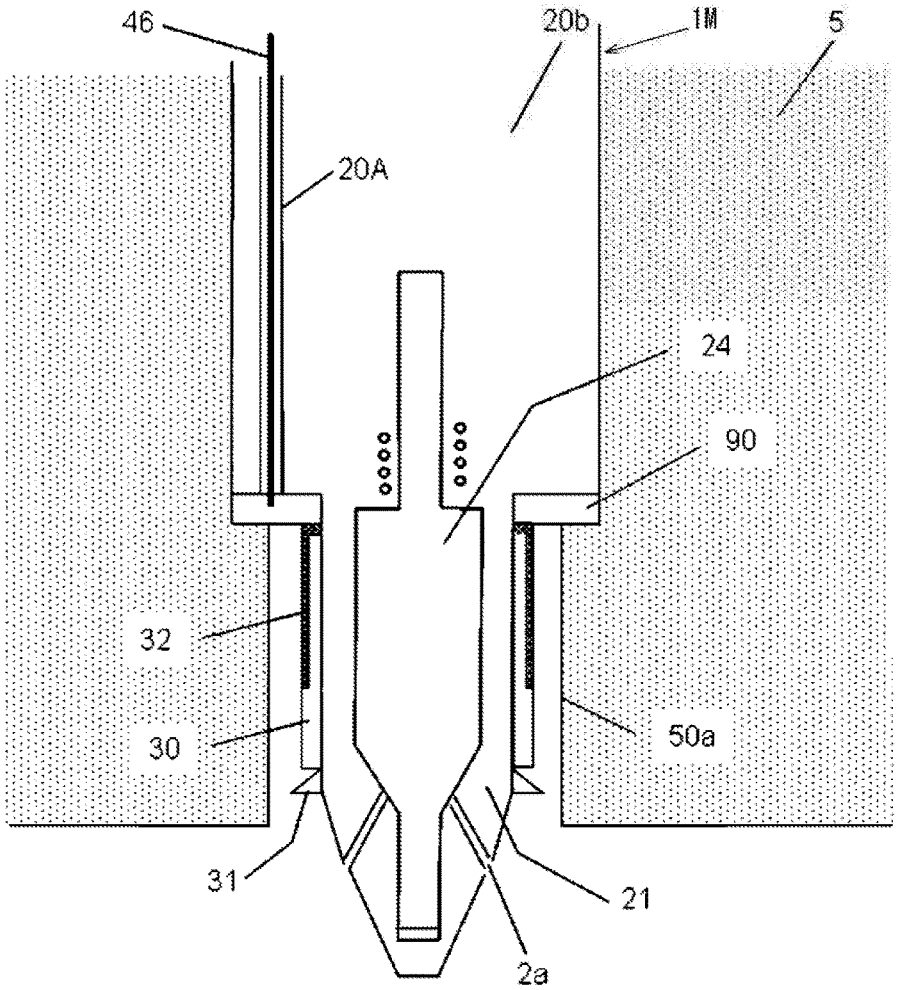
FIG. 29 is a front view of a partial cross section that illustrates an injector with a built-in ignition device of a fifteenth embodiment.
Figure 30:
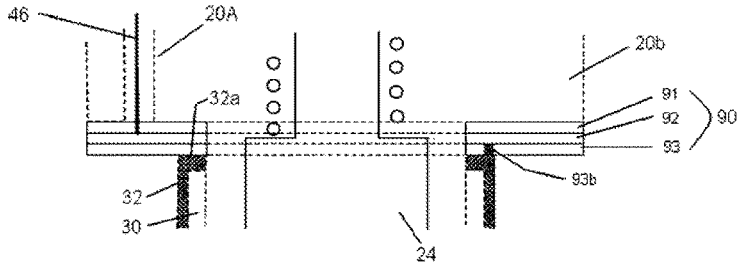
FIG. 30 is a front view of a partial cross section of the main part of the injector with the built-in ignition device of the fifteenth embodiment.

The fifteenth embodiment relates to an injector 1M with a built-in ignition device of the present invention (in below, it may only be referred to "injector 1M"). As illustrated in FIG. 29, the injector 1M includes a connection member 90 on the upper end of the fuel injection pipe 21 and at the lower surface of the center part 20*b* of the main body part 20. By referring to FIG. 30, the connection member 90 is a member for connecting the coaxial cable 46 configured to transmit the microwave with the resonance structural part that is constituted by, for example, the dielectric member 30. Further, it is annular circular shape that can be inserted at the upper end part of the fuel injection pipe 21.

Figure 31:
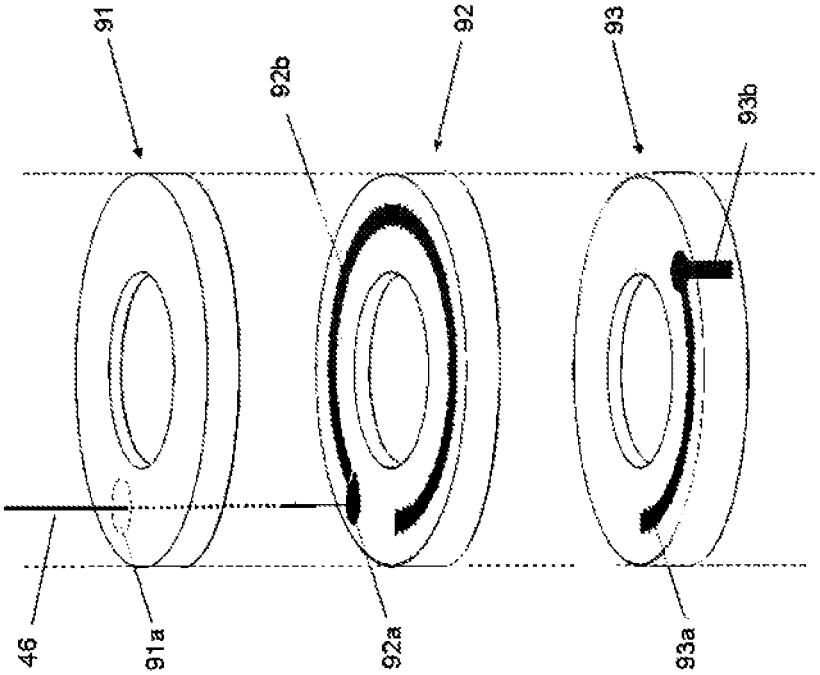
FIG. 31 is an exploded perspective view of a connection member 90 of the injector with the built-in ignition device of the fifteenth embodiment.

By referring to FIG. 31, the connection member 90 has a lamination structure of dielectric member substrates 91, 92, and 93 which are composed of ceramics. On the substrate 91 of the uppermost part (on the center part 20*b* side of the main body part 20), a hole 91*a* for inserting the coaxial cable 46 into is provided. On the top surface of the substrate 92 at the center, a conductor 92*a* for connecting the coaxial cable 46 and a circular arc conductor 92*b* are formed. These conductors are composed of, for example, tungsten or copper, and formed by the method of for example, printing. Similarly, a circular arc conductor 93*a* is formed on the top surface of the lowermost substrate 93. Moreover, a hole through which a conductor 93*b* is filled with is provided on the substrate 93. The conductor 93*b* electrically connects the conductor 93*a* to the metal film 32 for shielding the dielectric member 30.

The microwave that propagates through the coaxial cable 46 that is inserted in a through-hole 20A of the main body part 20, is entered into the conductor 92*b* from the conductor 92*a*, and flows through the surface of the conductor 92*b*. Next, the microwave is passed to the conductor 93*a* by capacitive coupling via the dielectric member substrate 92, and propagates to the metal film 32 by passing through the conductor 93*b*. The microwave propagates through the surface of the metal film 32 downward.

Here, as similar as the explanation in the fourth embodiment, the dielectric member 30 is partially covered by the metal film 32, and is not covered partially. The microwave flows on the surface of the metal film 32, while the microwave flows through the inside of the dielectric member 30. Accordingly, when the microwave reached to the lower end of the metal film 32 is entered into the dielectric member 30, the microwave flows through the entire dielectric member 30. Here, focusing on a part of the dielectric member 30 which is sandwiched between the metal film 32 and the fuel injection pipe 21, a standing (stationary) wave is generated by overlapping of the microwave that flows upward and the microwave that flows downward. If the length from the center of the part that is not covered by the metal film to the rear end of the dielectric member 30 is $\lambda/(4n)$, $\lambda$ is a microwave wavelength, and "n" is a refraction constant of the dielectric member, the upper end of the dielectric member 30 becomes node of the microwave, and the center of the part that is not covered by the metal film becomes anti-node of the microwave. Put simply, a line that is opened at an output end can be realized by the dielectric member 30, and thereby, the microwave voltage can efficiently be amplified.

The reason of providing the substrate 91 is because the surface of the center part 20*b* of the main body part 20, metal conductor, is electrically insulated from the conductors 92*a* and 92*b*. The reason of providing the substrate 93 is because the metal film 32 is electrically insulated from the conductor 93*a* (This is related to an impedance matching explained in the following paragraph).

The connection member 90 plays a role of attaining an impedance matching between the resonance structural part composed of, for example, the dielectric member 30 and the coaxial cable 46. A capacitive reactance element is formed between the conductor 92*b* and the surface of the center part 20*b*, and a capacitive reactance element is formed between the conductor 92*b* and the conductor 93*a*. Moreover, the conductor 92*b* itself has a resistance element and a coil element, and therefore, conversely by using these characteristics, the length of each part is changed accurately. Thereby, a complex impedance value can be adjusted. That is, by designing properly the length of each conductor, an impedance matching circuit between the resonance structural part and the coaxial cable 46 can be achieved. Accordingly, the connection member 90 functions as an impedance matching circuit as well as functions as connection of the microwave from the coaxial cable 46 to the resonance structural part.

Further, the connection member 90 can be realized solely by inserting a circular multilayer laminated substrate on the upper end of the fuel injection pipe 21, and therefore, an injector in existence is almost not required for being modified.

In the present embodiment, a through-hole 20A through which the coaxial cable 46 is inserted is specifically provided in the center part 20*b* of the main body part 20; however, a space can relatively be secured at the upper part of the main body part in the generally used injector, and therefore, it is considered there is no special trouble even if such a through-hole is mounted inside, from the viewpoint of the injector characteristic.

On the other hand the inside of the tip part (fuel injector pipe 21) of the injector has a precision mechanism such as a nozzle, piezoelectric element. Therefore, the inside of the tip part is not modified, and the propagation and boosting of the microwave are performed by, for example, coating the surface with the dielectric member.

The connection member 90 that attains an impedance matching and etc. is configured to be able to insert into the tip part of the injector, and the multilayer laminated substrate structure is adopted. Therefore, cost reduction caused by mass production can be performed. Moreover, the manufacturing is easily performed by simple assemble work, and the manufacturing cost can also be reduced.

—Modification of Fifteenth Embodiment—

As illustrated in FIG. 37, a stick type ceramic body 94 inside which a conductor 94*b* configured to conduct the microwave is inserted, may be put into a part of the through-hole 20A. By the use of the connection member 90, if it is difficult to realize the formation of the impedance matching circuit that has a sufficient large impedance due to lack of area (volume), the present modification can also be adopted.

One layer structure or two layers structure may be adopted if the matching circuit having a proper size impedance can be designed, i.e., the three layers substrates structure is not required for adopted. Conversely, if the impedance value is insufficient, i.e., shortage, a multilayer laminated substrate more than four layers structural substrate may be adopted.

(Sixteenth Embodiment)

Figure 32:
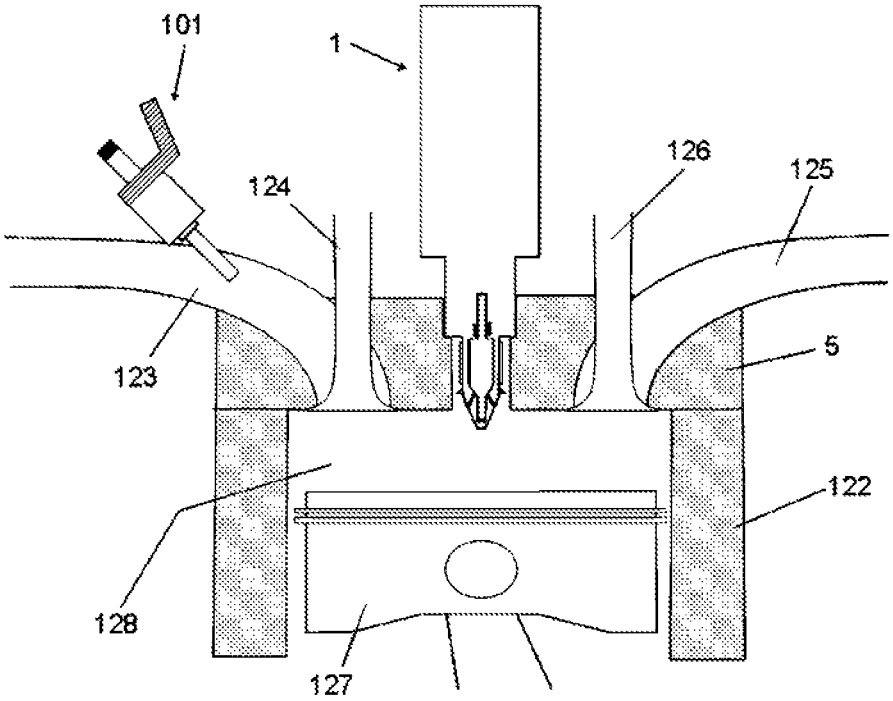
FIG. 32 is a front view of a partial cross section that illustrates an internal combustion engine of a sixteenth embodiment.

The present embodiment relates to an internal combustion engine which as a main injector, a injector configured to perform a part fuel injection is separately included, and the injector 1 with the built-in ignition device is used as a sub-injector. FIG. 32 illustrates an internal combustion engine of the present embodiment.

The internal combustion engine of the present embodiment includes the injector 1 with the built-in ignition device mounted to the cylinder head 5, and an injector 101 mounted to an intake port 123.

The injector 101 is an injector for part fuel injection configured to inject CNG fuel. The injector 1 with the built-in ignition device is any one of injectors of the above respective embodiments.

During the period of opening of the intake valve 124, for example, the period directly after the start of "intake stroke" until the crank angle reaches to about −120 degrees, i.e., before 120 degrees when the piston 127 reaches to TDC (top dead center), the fuel injection is performed by the injector 101 toward the combustion chamber 128. Then, after the close of the intake valve 124 and until the crank angle reaches to about 60 degrees, the fuel injection is performed by the injector 1. Then, the discharge can be performed and the ignition can be performed by superimposing the microwave into the injector 1.

Note that, the ignition may be performed by using a control sequence other than this.

(Seventeenth Embodiment)

The above respective embodiments relate to the injector with the built-in ignition device that forms resonance structure by providing, for example, the dielectric member at the side surface of the fuel injection pipe; however, an ignition device that the resonance structure is constituted by providing, for example, the dielectric member on the side surface of the conductor in solid type or hollow (cylindrical) type, can be obtained. The ignition device can be obtained only by replacing the fuel injection pipe 21 of the respective embodiments to a solid cylindrical conductor or hollow cylindrical conductor. That is, a concept of the present invention can be applied to, not only limited to the injector with the built-in ignition device, but also an ignition device including a booster configured to boost the electromagnetic wave by the resonance structure.

(Other Embodiment)

(1) Use as an "Aftermarket" Goods

The above injector 1 with the built-in ignition device is also suitable for an "aftermarket" goods. For example, the diesel engine that uses the diesel oil as fuel is modified so as to use CNG (Compressed Natural Gas) as fuel. In order to achieve this, the direct injection injector for diesel engine originally mounted may be removed off and replaced to the injector 1 of the present invention. The ignition temperature of CNG becomes in higher than that of the diesel oil, and the self ignition performance is impossible in a case where CNG fuel is supplied to a general diesel engine; however, by using the injector 1 with built-in ignition device, the generally-used diesel engine can be operated by CNG fuel. Accordingly, a motor vehicle owner can change using fuel from diesel oil to CNG only by changing the injector, without buying newly a vehicle. Thereby, the cost reduction of the owner can be achieved, and a disposal of the vehicle body is not required, and therefore, contributes to resource conservation.

Compared to a conventional injector, the injector 1 with the built-in ignition device includes the dielectric member 30 on the surface of the fuel injection pipe, and therefore, it is considered that there occurs an inconvenience that the distance between the injector and the inner wall of the cylinder head becomes shorter; however, if a process of exchanging to the injector 1 with the built-in ignition device is performed when the cylinder head is cleaned, such inconvenience does not occur. Because, the inner wall surface 50*a* is cut off a little bit by the cleaning (washing or polishing), and therefore, by compensating with the thickness of the dielectric member 30 for the cut off portion, the distance between the injector and the inner wall surface of the cylinder head can be kept in almost even before and after the exchange.

(2) Other Example 1 of Booster

In replace of the resonance structure of using a capacitance between the dielectric member 30 and the inner wall surface of the mounting port 50, solely the cable extended from the electromagnetic wave oscillator MW which is in the state of non-coated by the dielectric member 30 may wound around the surface of the fuel injection pipe 21. Here, if the length of wounding cable becomes ¼ wavelength of the microwave, the resonance structure can be formed without coating by the dielectric member 30 newly.

(3) Another Example 2 of Booster

The method of connecting the microwave transmitted by the cable (coaxial cable) from the electromagnetic wave oscillator MW to the dielectric member 30 is considered as, for example, a method of usage of connector, welding, or blazing. However, such connection is performed in the vicinity of the combustion chamber, and therefore, heat tolerance characteristic at the connection point is required to be considered. Therefore, the material with strong heat tolerance characteristic is required for being selected for use as the connector.

The tip end of the cable becomes a coil-state (referring to FIG. 3), the tip end may wound the surface of the dielectric member 30 that is performed coating on the surface of the fuel injection pipe 21, and the microwave passing through the cable may be transmitted to the dielectric member by the capacitive coupling or spatial coupling with the dielectric member.

(4) Plasma Ashing

When CNG is used as fuel there is a risk that the discharge cannot be performed normally caused by adhesion of a large amount of carbon to the discharge electrode. The carbon is generated on the engine operation (combustion). Most of the carbon stuck to the discharge electrode can be burned-out completely by the heat generated on combustion, however, somewhat carbon is remained with adhesion to the discharge electrode. Then, the discharge is performed between the discharge electrode 31 and the ground electrode 51 on non-operational period (under the circumstance where the fuel is not injected) for eliminating carbon. Thereby, the stuck carbon can be removed off. For example, directly before the engine is turned-off on the operational end timing, or directly after the engine is turned-on on the operational start timing, it may be set such that the discharge is caused in the non fuel injection state. Further, as illustrated in FIG. 13, if carbon storage room is formed on immediately above of the discharge removal of carbon can effectively be performed.

(5) Application to a Rotary Engine

The injector 1 with the built-in ignition device is not only limited to, so called, reciprocating engine, the injector 1 can be applied but also to rotary engine. In a case of the rotary engine, there is a risk to contact with the rotor. Therefore, the structure that the spark plug or the injector is protruded toward the combustion chamber cannot be adopted. Therefore, it is difficult to improve an ignition performance and there is a limitation for enhancement of the performance. However, according to the injector with the built-in ignition device of the present invention, since there is, so called a "plasma jet effect" as above, the combustion inside the combustion chamber can effectively be performed in a case where the injector or the spark plug is not protruded toward the combustion chamber. In other words, the inside of narrow cavity formed between the injector and the cylinder mounting port becomes temperature in high and pressure in high by the discharge from the discharge electrode. By such pressure, the plasma is pushed toward the combustion chamber side.

(6) Air-fuel Ratio Improvement

The injector with the built-in ignition device is driven by the microwave as a source, and therefore, differing from the generally-used spark plug, speed in high and continuous discharge can be performed, and non local thermodynamic equilibrium plasma having an arbitrary size can be generated on an arbitrary timing. This cannot be achieved by the conventional spark plug, and based on this, improvement of air-fuel ratio, i.e., fuel consumption reduction, can be achieved. Note that, even with the ignition device alone of the seventeenth embodiment, the same effect can be obtained.

Moreover, limitation of A/F of current gas engine is about 28, and if the injector with the built-in ignition device is used, it can be possible to become A/F 30. In this case, so called, lean catalyst, is also unnecessary. Accordingly, if the injector with the built-in ignition device is used, the engine without the catalyst can be realized, the cost for catalyst preparation can be saved, and eventually, the cost reduction can be achieved.

(7) Removal of Deposit Such as Oil, Soot

Microwave in pulse is supplied into the injector with the built-in ignition device as a source, and thereby, non local thermodynamic equilibrium plasma can be generated in the vicinity of the tip part of the injector. On the other hand, if microwave in continuous wave (CW) is supplied to the injector with the built-in ignition device, the heated plasma can be generated in the vicinity of the tip part of the injector based on, so called, an "induction heating effect" of the microwave. Put simply, the tip part of the injector can become high in temperature, and therefore, deposit such as oil and soot that are stuck to the injector can be removed off. The adhesion of deposit such as oil and soot is one of defects of the direct injection injector, but heat can be generated at the tip part of the injector by driving continuously the microwave according to the injector with the built-in ignition device of the present invention, and thereby, the deposit can be removed off.

Specifically, in the rotary engine, ashed soot (carbon) can be blown off caused by the high speed blow (for example, 100 m/sec) that is generated in accordance with the high speed rotation of the rotor, and therefore, further effective removal can be performed. On the engine operational start timing, an offensive smell is generated due to the incomplete combustion of oil stuck to the engine, and etc. Then, on the engine operational start timing, the heated plasma is generated by the injector with the built-in ignition device, and these deposit is burned out completely, and the offensive smell can be suppressed.

Such effect can be obtained, not only limited to, by the injector with the built-in ignition device, but also, by the ignition device illustrated in the seventeenth embodiment.

INDUSTRIAL APPLICABILITY

As explained as above, the injector with the built-in ignition device of the present invention has a simplified structure that the resonance structure of the ignition device is accomplished by the dielectric member formed on the surface of a fuel injection pipe of a fuel injection device, and the ignition device can boost the electromagnetic wave and perform a discharge. Therefore, malfunction or damage of an actuator due to the effect of the high voltage are suppressed, and the outer diameter length of the device as a whole can be reduced. Thereby, arranging position of the injector is freely selected, and it can be used to various kinds of internal combustion chambers. Moreover, the injector can be used to the internal combustion engine based on the gasoline engine, diesel engine, which uses as fuel, natural gas, coal gas, shale gas, bio fuel and etc. More specifically, the injector can be suitably used for the internal combustion engine based on the diesel engine, which uses as fuel, gas (CNG gas or LPG gas), from the viewpoint of fuel consumption reduction and the environmental engineering. Further, the injector can be used for the gasoline direct injection engine that uses gasoline as fuel, gas engine, engine for power generation (combined heat and power), gas turbine, gas burner, and etc. Moreover, the injector can be used for not only the reciprocating engine but also for the rotary engine.

NUMERAL SYMBOL EXPLANATION

1 Injector with built-in Ignition Device
2 Fuel Injection Device
20 Main Body Part
2*a* Fuel Injection Port
22 Biasing Means
23 Fuel Sump Room Chamber
24 Nozzle Needle
25 Pressure Room
3 Ignition Device
30 Dielectric Member
31 Discharge Electrode
5 Cylinder Head
50 Mounting Port (Injector Mounting Port)
51 Ground Electrode The invention is:

1. An injector with a built-in ignition device, that is arranged in a mounting port of a cylinder head of an internal combustion engine and comprises:

the built-in ignition device comprising a booster and a discharger, the booster having a resonance structure configured to boost an inputted electromagnetic wave, the discharger being provided at an output side of the booster; and a fuel injection device comprising a fuel injection pipe with a fuel injection port and configured to perform a fuel injection from the fuel injection port of the fuel injection pipe, wherein the resonance structure is configured with a dielectric member formed on a surface of the fuel injection pipe and an inner wall surface of the mounting port of the cylinder head, and wherein the discharger comprises a projection formed on the surface of the fuel injection pipe at a position adjacent to the inner wall surface of the mounting port of the cylinder head and configured to cause a discharge between the projection and the wall surface of the mounting port.

2. An internal combustion engine, comprising the injector with the built-in ignition device according to claim 1.

3. An internal combustion engine comprising:

a main injector mounted on an intake port provided with an intake valve; and the injector with the built-in ignition device according to claim 1, that is mounted to a cylinder head, wherein the internal combustion engine is configured to perform a fuel injection from the main injector when the intake valve is open, and to perform the fuel injection from the injector with the built-in ignition device after the intake valve is closed.

4. The injector according to claim 1, wherein a capacitor element C is formed between the inner wall surface the housing member and the dielectric member, and the capacitor element C and an inductor element L of the dielectric member satisfy the following formula:

$$f = \frac{1}{2\pi\sqrt{LC}}$$

in which "f" indicates a frequency of the electromagnetic wave.

5. An injector with a built-in ignition device, that is arranged in a mounting port of a cylinder head of an internal combustion engine and comprises:

the built-in ignition device comprising a booster and a discharger, the booster having a resonance structure configured to boost an inputted electromagnetic wave, the discharger being provided at an output side of the booster; and a fuel injection device comprising a fuel injection pipe with a fuel injection port and configured to perform a fuel injection from the fuel injection port of the fuel injection pipe, wherein the resonance structure is configured with a dielectric member that is formed on a surface of the fuel injection pipe and a conductor member that covers a surface of the dielectric member, and wherein the discharger comprises a projection formed on the surface of the fuel injection pipe at a position adjacent to the inner wall surface of the mounting port of the cylinder head and configured to cause a discharge between the projection and the wall surface of the mounting port.

6. The injector according to claim 5, wherein a capacitor element C is formed between the inner wall surface the housing member and the dielectric member, and the capacitor element C and an inductor element L of the dielectric member satisfy the following formula:

$$f = \frac{1}{2\pi\sqrt{LC}}$$

in which "f" indicates a frequency of the electromagnetic wave.

7. An injector with a built-in ignition device, that is arranged in a mounting port of a cylinder head of an internal combustion engine and comprises:

the built-in ignition device comprising a booster and a discharger, the booster having a resonance structure configured to boost an inputted electromagnetic wave, the discharger being provided at an output side of the booster; and a fuel injection device comprising a fuel injection pipe with a fuel injection port and configured to perform a fuel injection from the fuel injection port of the fuel injection pipe, wherein the resonance structure is configured with a dielectric member with a high dielectric constant which is eight or more of relative permittivity, the dielectric member being formed on a surface of the fuel injection pipe, and wherein the discharger comprises a projection formed on the surface of the fuel injection pipe at a position adjacent to the inner wall surface of the mounting port of the cylinder head and configured to cause a discharge between the projection and a wall surface of the mounting port.

8. The injector according to claim 7, wherein a capacitor element C is formed between the inner wall surface the housing member and the dielectric member, and the capacitor element C and an inductor element L of the dielectric member satisfy the following formula:

$$f = \frac{1}{2\pi\sqrt{LC}}$$

in which "f" indicates a frequency of the electromagnetic wave.

9. A gas burner comprising:

a fuel injection device having an injection port and configured to inject fuel from the injection port;

a housing member configured to house therein the fuel injection device;

an oscillator configured to oscillate an electromagnetic wave;

a booster formed on a side surface of the fuel injection device and having a resonance structure configured to boost the electromagnetic wave;

an inlet port provided at a side of the injection port and configured to introduce air; and a mixing tube configured to mix the fuel injected from the injection port with the air introduced from the inlet port, wherein the resonance structure is configured with a dielectric member formed on the side surface of the fuel injection device and an inner wall surface of the housing member, and wherein a capacitor element C is formed between the inner wall surface the housing member and the dielectric member, and the capacitor element C and an inductor element L of the dielectric member satisfy the following formula:

$$f = \frac{1}{2\pi\sqrt{LC}}$$

in which "f" indicates a frequency of the electromagnetic wave.

* * * * *